US006776742B2

(12) United States Patent
Domenge

(10) Patent No.: US 6,776,742 B2
(45) Date of Patent: Aug. 17, 2004

(54) HANDHELD EXERCISER AND AMUSEMENT DEVICE, METHOD OF EXERCISING THEREWITH

(76) Inventor: Alberto G. Domenge, Fuente de las Aguilas #194, Tecamachalco, Edo de Mex (MX), 53950

( * ) Notice: Subject to any disclaimer, the term of this patent is extended or adjusted under 35 U.S.C. 154(b) by 0 days.

(21) Appl. No.: 09/995,694

(22) Filed: Nov. 29, 2001

(65) Prior Publication Data

US 2003/0100418 A1 May 29, 2003

(51) Int. Cl.[7] ..... A63B 21/22
(52) U.S. Cl. ..... 482/110; 482/148; 482/118
(58) Field of Search ..... 482/110, 115, 482/118, 121–130, 49, 50; 272/80; 46/52

(56) References Cited

U.S. PATENT DOCUMENTS

| | | | | |
|---|---|---|---|---|
| 983,372 A | | 2/1911 | Johnson | |
| 1,676,015 A | | 7/1928 | Feick | |
| 2,821,394 A | | 1/1958 | Barbeau | |
| 2,948,531 A | | 8/1960 | Johnson | |
| 2,999,333 A | | 9/1961 | Clark | |
| 3,013,806 A | | 12/1961 | Boyd | |
| 3,062,543 A | * | 11/1962 | Shaboo et al. | 272/80 |
| 3,083,037 A | | 3/1963 | Gordon et al. | |
| 3,083,979 A | | 4/1963 | Boyd | |
| 3,157,961 A | | 11/1964 | Payne | |
| 3,334,915 A | | 8/1967 | Sulyma et al. | |
| 3,403,906 A | | 10/1968 | Burzenski | |
| 3,464,718 A | | 9/1969 | Fisher | |
| 3,482,835 A | | 12/1969 | Dean | |
| 3,550,312 A | * | 12/1970 | East | 46/52 |
| 3,708,164 A | | 1/1973 | Griffin | |
| 3,796,431 A | | 3/1974 | Sinyard | |
| 3,809,393 A | | 5/1974 | Jones | |
| 3,867,787 A | | 2/1975 | Weinger | |
| 3,901,505 A | | 8/1975 | Gerechter | |
| 4,043,553 A | | 8/1977 | Suarez | |
| 4,049,264 A | | 9/1977 | Holcombe, Jr. | |
| 4,150,580 A | | 4/1979 | Silkebakken et al. | |
| 4,171,805 A | | 10/1979 | Abbott | |
| 4,278,248 A | | 7/1981 | Kifferstein | |
| 4,429,487 A | | 2/1984 | Taylor et al. | |
| 4,458,895 A | | 7/1984 | Turcotte | |
| 4,501,434 A | | 2/1985 | Dupuis | |

(List continued on next page.)

FOREIGN PATENT DOCUMENTS

| | | |
|---|---|---|
| DE | 2043395 | 3/1972 |
| DE | 3042430 | 6/1982 |
| DE | 92066739 | 9/1992 |
| FR | 888063 | 3/1942 |
| FR | 2101365 | 3/1972 |
| GB | 2244009 | 11/1991 |
| WO | 0240107 | 5/2002 |

OTHER PUBLICATIONS

NASA document titled "Toys In Space II", dated 1997, describing certain toys demonstrated on Space Shuttle Mission STS–54, Jan. 1993.

(List continued on next page.)

*Primary Examiner*—Nicholas D. Lucchesi
*Assistant Examiner*—L Amerson
(74) *Attorney, Agent, or Firm*—Greenblum & Bernstein, P.L.C.

(57) ABSTRACT

A method of exercising and a handheld exercise or amusement device are provided. The handheld exercise and amusement device includes a handle adapted to be gripped by a user and at least two weights which are at least one of freely rotatably mounted and freely orbitally mounted about an axis running through the handle. The method of exercising includes gripping the exerciser with at least one hand and moving the exerciser in at least one direction.

42 Claims, 20 Drawing Sheets

U.S. PATENT DOCUMENTS

| | | | |
|---|---|---|---|
| 4,513,963 | A | 4/1985 | Nelson et al. |
| 4,579,336 | A | 4/1986 | Morin |
| 4,632,391 | A | 12/1986 | Orak |
| 4,703,928 | A | 11/1987 | Escher |
| 4,714,246 | A | 12/1987 | Parisien |
| 4,775,147 | A | 10/1988 | Bold, Jr. |
| 4,900,017 | A | 2/1990 | Bold, Jr. |
| 5,046,727 | A | 9/1991 | Wilkinson et al. |
| 5,163,888 | A | 11/1992 | Stearns |
| 5,244,445 | A | 9/1993 | Amesquita |
| 5,304,108 | A | 4/1994 | Donega et al. |
| 5,643,162 | A | 7/1997 | Landers et al. |
| 5,707,325 | A | 1/1998 | Chiou |
| 5,792,031 | A | 8/1998 | Alton |
| 6,099,444 | A | 8/2000 | Domenge |
| 6,179,758 | B1 | 1/2001 | Domenge |
| 6,488,613 | B1 | 12/2002 | Domenge |
| 6,500,102 | B1 | 12/2002 | Domenge |

OTHER PUBLICATIONS

Packaging label for a device labeled "Klika®". The label identifies the following numbers TM #F–161928 and Patent #FP–02–04568.

Advertisement titled "Clackers Ball", printed off the Internet Dec. 12, 2003.

Article titled "ToyNfo.com The Vintage Toy Encyclopedia", printed off the Internet Dec. 12, 2003.

Advertisement showing a device labeled "Klackers", printed off the Internet Dec. 12, 2003.

* cited by examiner

Fig. 6
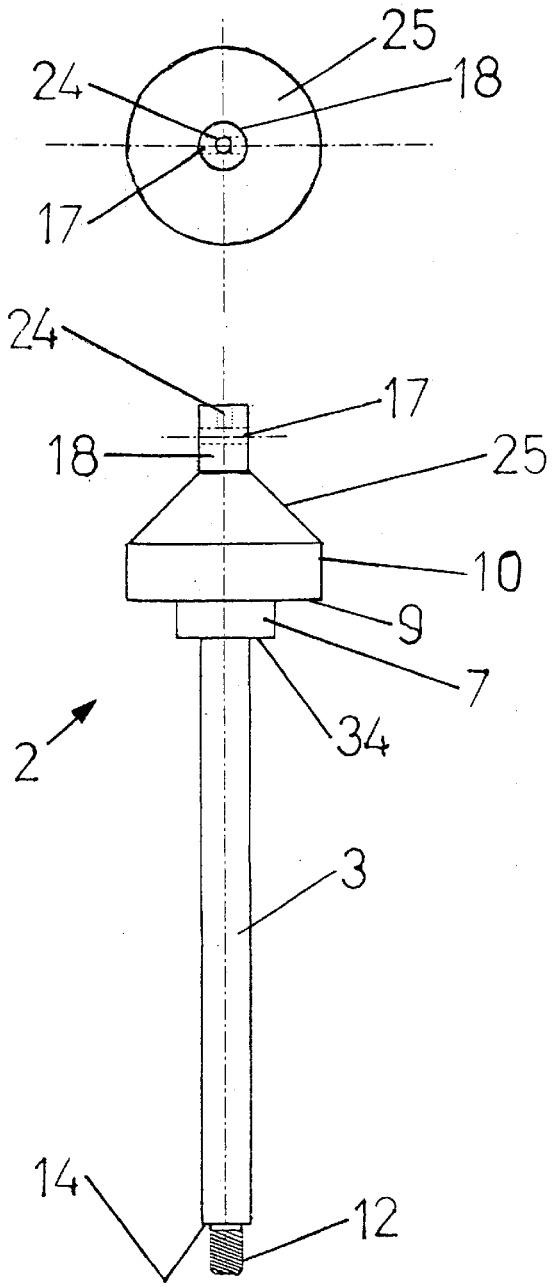
Fig 7
Fig 8
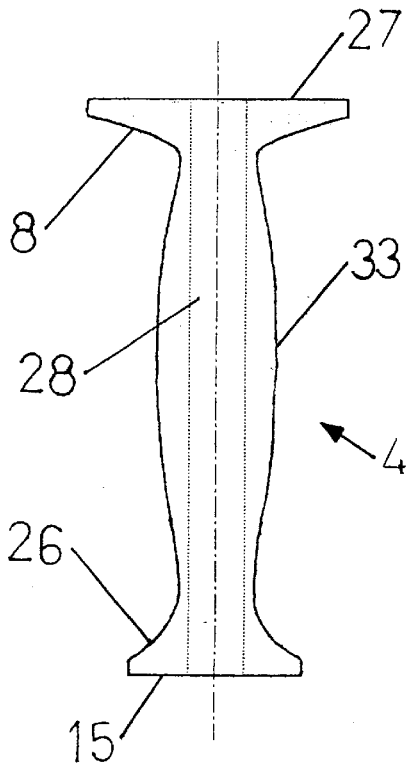

Fig 22
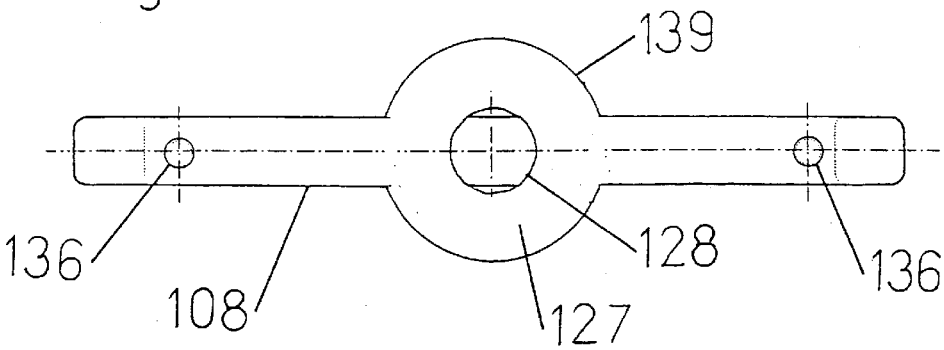
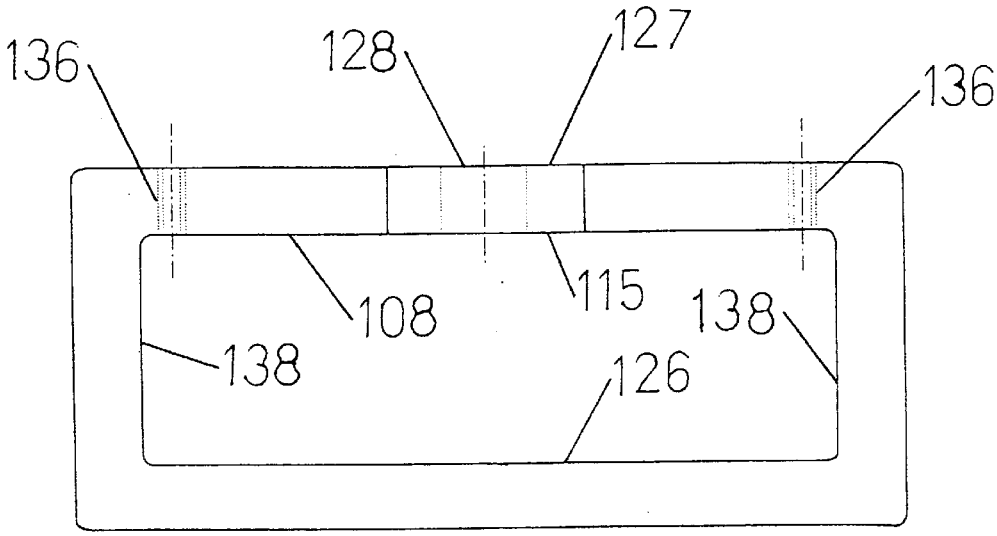
Fig 23
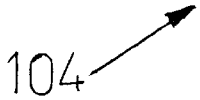
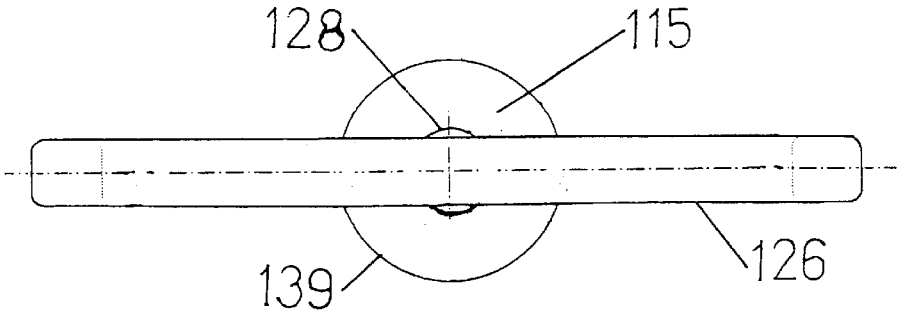
Fig 24

Fig 29
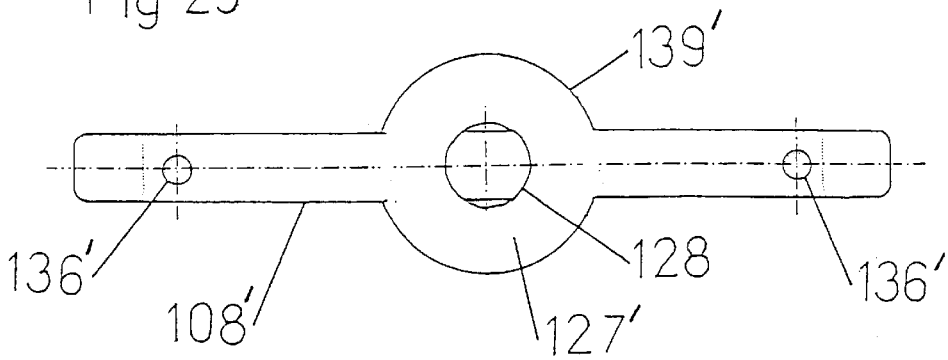
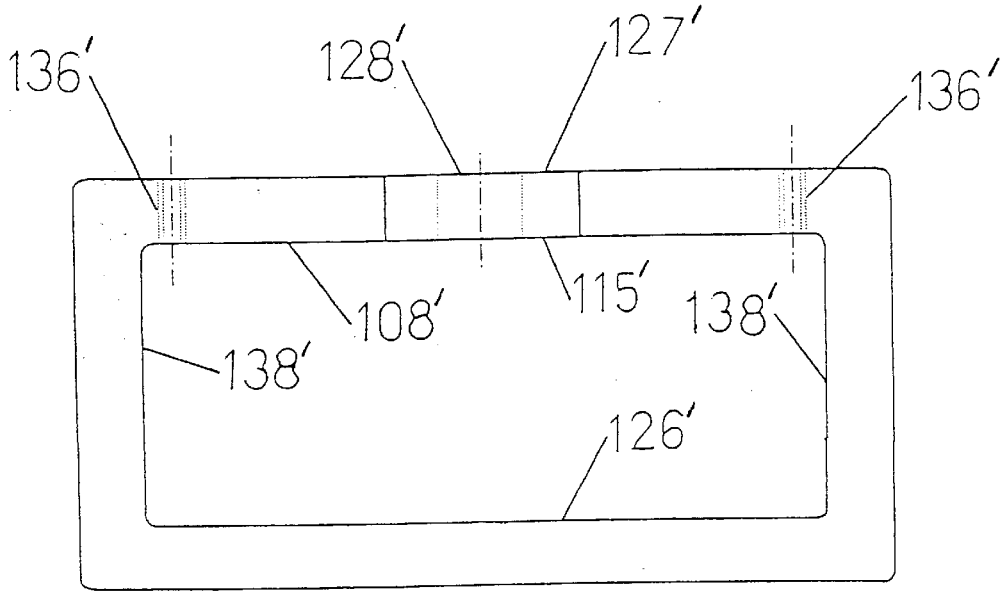
Fig 30
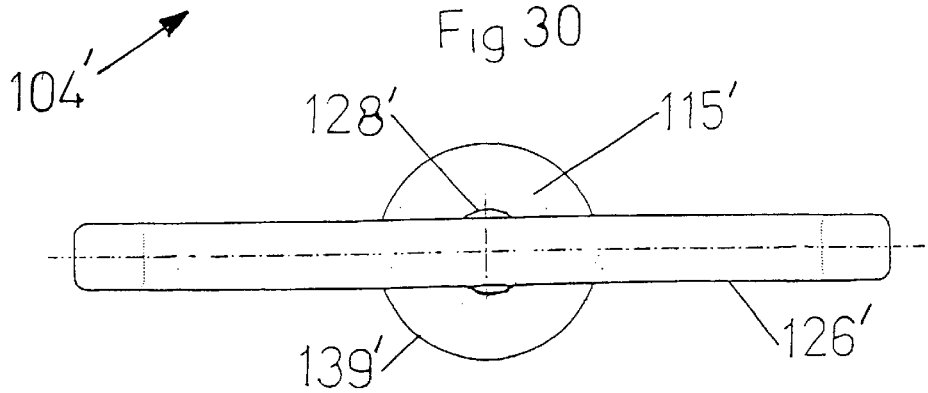
Fig 31

HANDHELD EXERCISER AND AMUSEMENT DEVICE, METHOD OF EXERCISING THEREWITH

BACKGROUND OF THE INVENTION

1. Field of the Invention

The present invention relates to handheld exercise devices and/or amusement devices, which utilize a central handle and a pair of weights which can rotate about the handle so as to impact one another.

2. Discussion of Background Information

The public, young and old, have become more and more aware of the benefits of exercising, which have presently become almost axiomatic. One reason for this is because exercising translates into a healthier and longer life. Additionally, exercising and being fit is no longer a question of looks, it is a matter of having a better quality of life. As a result, the types of machines and exercising devices that have appeared on the market have multiplied greatly to the point that it is difficult to provide an exhaustive description or classification of such devices. However, in general, such exercising devices may be characterized as being bulky, complicated and expensive. Other common features of most of these conventional exercising devices are that their use is often monotonous and even extremely boring. Accordingly, there exists a need for an exerciser which has at least some of the following advantages: simplicity in its mechanical structure; high reliability; low cost; small size; and fun to use, i.e., thereby providing amusement. Moreover, such a device should also offer to the user the challenge of becoming more and more proficient in executing the numerous, varied and beneficial exercises which can be performed with the device.

One type of conventional inertial exerciser utilizes eccentric weights. Some selected patents illustrating this type of exerciser are the following: U.S. Pat. Nos. 4,714,246; 4,513,963 and 4,043,553.

U.S. Pat. No. 4,714,246 discloses a disk provided with two diametrically opposed handles. A resilient ball is tethered to the center of the disk by a flexible, but substantially inelastic line, the line being slightly shorter than the radius of the disk. Weights may be attached to the device. Proper flexions and extensions of the arms or of other parts of the user's body set the ball in a periodic bouncing motion. The rhythm thus established regulates the various exercises of the user.

U.S. Pat. No. 4,513,963 discloses a body exercise apparatus which includes a tubular member having a length significantly greater than the width of a person's shoulders with bearings disposed within the tubular member adjacent the ends thereof. A bar member is disposed within the tubular member along the axis thereof, the ends of the bar member extending through and beyond the bearings and connector sections associated with the exposed end sections of the bar member. Each of the connector sections includes at least one opening, the opening being of a size slightly larger than the cross section of the exposed bar member end section. A weight is permanently affixed adjacent the opposite end of each connector section, the exposed bar member end section being engageable with the connector section opening. A fastener secures each connector section to an exposed bar member end section in an orientation substantially perpendicular to the tubular member, and a protective covering is disposed over the weight, the connector sections and at least a portion of the tubular member.

U.S. Pat. No. 4,043,553 discloses an exercise device for improving muscular tone, primarily of the upper torso and arms. Circular motion is imparted to a pair of hand grips rotatably secured to an eccentrically weighted cross shaft. Sufficient tolerance is provided between the cross shaft and the hand grips so that the cross shaft is free to move in an orbital path eccentric to the center of the hand grips, wherein the orbital movement of the hand grips and the eccentric orbital movement of the cross shaft may be utilized to exercise various muscles of the body.

Other conventional exercise devices are discussed below.

U.S. Pat. No. 3,796,431 discloses an exercising device in the form of a dumbbell. The device is provided with rotatable spherical weights, which allow the device to be used by being rolled along a flat surface such as a floor or wall, in addition to being used by lifting the device in a conventional manner.

U.S. Pat. No. 4,900,017 is a device similar to that described above, in which an inertial force exercise device includes a wheel member operable to engage and roll on a surface during an exercise routine. An axle member extends in a predetermined manner so as to be controlled by an operator of the device. An inertial mass structure is connected to the axle for translation with the axle, without rotation with respect to the axle, for providing an inertial resistance through non-rotational translation so as to exercise a user's body. Due to the mass of the device, a substantial linear inertia is produced.

U.S. Pat. No. 4,140,580 discloses a hand-held ball shaped case having a shaft mounted inertial wheel or rotor provided with fins. The casing leaves part of the rotor exposed, so that an initial spin can be imparted to it. Afterwards, the rotor spins so that it is maintained by imparting a periodic motion thereto. The device is basically a gyroscope with a race designed for providing smooth rotor movement.

U.S. Pat. No. 3,809,393 discloses an exercise device having a handle supported by at least three swivel casters. The device can be moved about a floor. However, this device does not appear to truly be an inertial exercise device as it does not produce inertial resistance to the movement imparted to the device by a user.

U.S. Pat. No. 4,775,147 is an inertial exercise device having three independent rotational inertial systems. A plurality of wheel and axle elements cooperate with weight elements so that rolling of the devices produces an inertial force. The device appears to be for floor-type exercise and is directed to an open-type, non-protected weight element for providing the inertial force when initially moved by a user.

U.S. Pat. No. 4,171,805 is directed to a rollable hand held exercise device that requires an additional, stationary element to provide a rolling surface. The device is not a true inertial-type exercise device as it requires a special surface to provide rolling contact surfaces which the user must use in conjunction with the weights so as to guide the weights in a manner designed to force certain muscle groups to work.

U.S. Pat. No. 5,046,727 is a wrist exercise device having a hollow shaft which houses a spring element. Tension disks are connected to the springs so that the disks can be moved toward and away from each other by turning a tension adjusting knob at ends of the device.

U.S. Pat. No. 5,643,162 discloses an exercise apparatus which is used in a forward and/or lateral movement in an extension type of exercise. While rolling and/or sliding of the device is considered, inertial exercise is not truly disclosed. This is an example of a low-friction type exercise device that, on its surface, may appear to be an inertial exercise device. However, it is apparent that low-friction type exercise does not imply an inertial exercise element.

U.S. Pat. No. 5,707,325 discloses an exercise device relating to a roller type device. The exerciser includes a roller for rolling along a first direction from a first position. Intermediate positions are defined as the device proceeds from the first position to the final position. The route of the device is then repeated back to the start position. Energy storing devices are provided to effect movement from one position to another. The energy storing devices are springs which are contracted and released as the device moves from one position to another.

U.S. Pat. No. 5,163,888 discloses an exercising apparatus in which different linkages are moved in response to movement of a user. The movements of the various links function to provide a resistance against which the user must work.

U.S. Pat. No. 5,304,108 discloses a resist and assist exercising device. The device allows the user to impart movement to the exercise device along a particular direction and the user may continue the application of force in that direction. Alternatively, the user may resist the force imparted in the first direction by trying to impart force thereto in another direction. However, while the exerciser is of the assist/resist type, the device operates by use of an essentially weightless mass. Thus, it is not a true inertial type exercise device.

U.S. Pat. No. 3,403,906 discloses an exerciser with grippers mounted on a shaft. This exerciser is again a roller type exercise device which does not require the user to work against an inertia imparted to the device by the user.

U.S. Pat. No. 3,708,164 discloses a manual torsion exerciser in which a torsional member is positioned within a tubular member and extends from the outer end part of one tubular member to the outer end part of another tubular member. A retainer member is releasably engaged with one end of the torsional member so that the torsional member is placed under torsional stress upon rotation of one tubular member relative to the other tubular member.

U.S. Pat. No. 2,821,394 discloses a spring-roller type exercise device in which the device is rolled on a floor so as to cause the user to impart force to a coil-type spring. Movement of the exerciser back and forth along the floor coils and uncoils the spring, forcing the user to work against the spring force in a coiling and uncoiling mode.

U.S. Pat. No. 4,703,928 discloses a precessional exercise device designed only for foot exercises. A spinning mass forms the rotor of a motor for spinning the mass. Rotational movement of the foot is opposed by a gyroscopic effect produced by the spinning mass. This produces an isometric exercise effect when the foot is rotated while the torque of the spinning mass is opposed by other muscles of the foot.

U.S. Pat. No. 5,244,445 discloses an exercise wand. The wand has a hollow rigid tube having a length sufficient to extend a substantial distance to either side of the body median plane. A plurality of spheres are enclosed in the hollow wand. Movement in one direction causes the spheres to roll in the wand from end to end and add momentum to the movement so as to provide an extra push to the movement of the body.

U.S. Pat. No. 3,482,835 discloses a barbell with an eccentric weight. Movement of the barbell causes a force to be imparted to the weight so that it rotates eccentrically about the shaft of the barbell. The device uses the effects of centrifugal force to require the user to coordinate his/her movement of the barbell with the movement of the eccentric weight.

The foregoing devices are of different types and are designed to produce different results. Each type of exercise device has its own advantages and disadvantages. However, all of these known exercising devices have at least one common disadvantage. They are not simple in design and construction in comparison to their advantages, if any, regarding exercising and/or providing amusement. They do not utilize the effects of rotating and/or orbiting weights which impact each other. They also do not provide the user, and/or those watching the user, with a form of amusement of the character of the instant invention. Finally, they do not permit a user to first impart movement to an exercise device and then work against the imparted movement in a variety of ways so as to provide a complete workout for a user or a team of users. The foregoing devices require the use of, among others, tension springs, compression springs, eccentrically mounted weights, offset shafts, etc., all of which unnecessarily complicate such exercising devices and necessarily lead to an increased cost of manufacture and a consequent increased cost to the consumer.

SUMMARY OF THE INVENTION

The invention of the present application was developed to overcome the problems of known exercising devices. More particularly, the invention was designed to provide an exercise device that is effective in promoting healthy exercise with a minimum of stress to the muscle groups so as to thereby avoid injuries often associated with exercise, and which provides a form of amusement. In addition, the exercise device of the present invention relies on a simple, though ingenious, design for coaxing a maximum workout from a user while at the same time permitting the user to enjoy the workout as a form of amusement. Of course, the user may view and/or utilize the device, not as an exerciser with amusement characteristics, but solely as a form of amusement, without departing from the scope of the invention.

According to one aspect of the present invention, a handheld exercise or amusement device is provided that includes a handle which is adapted to be gripped by a user and at least two weights which are at least one of freely rotatably and freely orbitally mounted about an axis running through the handle.

In other aspects of the present invention, the handle may rotate about the axis and the device may further include a support member, wherein the handle is rotatably mounted to the support member. The device may further include a support member, wherein the at least two weights are coupled to the support member via at least one tension member. Each of the at least two weights may include a sphere. The device may further include at least one tension member for coupling each of the at least two weights to the device. The device may further include one of a disk and a plate disposed between the at least two weights and the handle. The device may further include a support member, wherein the handle is rotatably mounted to the support member and wherein the at least two weights are coupled to the support member via at least one tension member.

In further aspects of the present invention, each of the at least two weights may include a sphere and the device may further include at least one tension member for coupling each of the spheres to the device. The device may further include one of a disk and a plate disposed between the spheres and the handle. The device may further include a mechanism for securing a portion of the at least one tension member to the support member. The device may further include at least one retaining mechanism, wherein the at least one retaining mechanism is adapted to axially retain the handle on the support member. The at least one retaining mechanism may include at least one washer and at least one nut. The handle may include an ergonomic gripping surface. The handle may include at least one of a soft and high friction gripping surface. The device may further include a first disk arranged between the at least two weights and the handle, and at least one of a second disk and a cover arranged on a side of the at least two weights opposite the handle.

The present invention also contemplates a handheld exercise or amusement device, including a support member, a handle adapted to be gripped by a user, and at least two weights being at least one of freely rotatably and freely orbitally mounted about an axis running through the handle. The handle is rotatably mounted to the support member and the at least two weights are coupled to the support member via at least one tension member.

In other aspects of the present invention, each of the at least two weights may have a spherical shape. At least one of the handle, the at least two weights, and the support member may include a plastic. The at least one tension member may be a string or a flexible tension member.

In another aspect of the present invention, a handheld exercise or amusement device is provided that includes a support member, a handle adapted to be gripped by a user, at least two weights being at least one of freely rotatably and freely orbitally mounted about an axis running through the support member, and one of a plate and a disk arranged between the handle and the at least two weights. The handle is rotatably mounted to the support member and the at least two weights are coupled to the support member via at least one tension member.

According to another aspect of the present invention, there is provided a method of exercising using a device which includes a handle adapted to be gripped by a user and at least two weights being at least one of freely rotatably and freely orbitally mounted about an axis running through the handle, wherein the method includes gripping the exerciser with at least one hand and moving the exerciser in at least one direction.

Another aspect of the present invention also provides for a method of exercising using a device that includes a support member, a handle adapted to be gripped by a user, and at least two weights being at least one of freely rotatably and freely orbitally mounted about an axis running through the handle, wherein the handle is rotatably mounted to the support member and wherein the at least two weights are coupled to the support member via at least one tension member, wherein the method includes gripping the bar with at least one hand and moving the exerciser in at least one direction.

In another aspect of the present invention, a method of exercising is further provided using a device that includes a support member, a handle adapted to be gripped by a user, at least two weights being at least one of freely rotatably and freely orbitally mounted about an axis running through the support member, and one of a plate and a disk arranged between the handle and the at least two weights, wherein the handle is rotatably mounted to the support member and wherein the at least two weights are coupled to the support member via at least one tension member, and the method includes gripping the bar with at least one hand and moving the exerciser in at least one direction.

An exercise may be performed, in a first mode of operation, by moving the exerciser with a linear and/or reciprocating motion in a direction substantially perpendicular to the axis of the handle. Operating the exerciser in this manner, causes the balls or spherical weights, to get into a repetitive cycle. As a result, they oscillate in opposite directions until the balls reach a colliding point, then they change their sense of oscillation until the balls or weights collide again, changing their sense of rotation, and so on. Alternatively, in another mode of operation, the exerciser can be actuated orbitally, that is with a substantial continuous circular motion. In this mode of operation, the weights also spin with a continuous circular motion.

Thus, one object of the invention is to provide an exerciser with two equal connecting tension members articulated in one end to a common central axle or support. The connecting or tension members are provided in their outer end with weights, preferably spherical, with the connecting strings and their weights being capable of colliding with each other when a reciprocating motion is applied to the exerciser. The weights are thus designed to collide with one another periodically at the end of each oscillating stroke.

Another object of the invention is to provide an exerciser capable of being operated at any "attitude" or incline angle (which is substantially perpendicular to a handle axis) imparting to it by the user a linear or circular reciprocating motion.

Another object is to provide an exerciser capable of being operated by imparting to it a substantially circular continuous motion, in which case the strings or tension members and their weight, also move, without colliding, with a circular continuous motion.

Another object of the invention is to provide an exerciser, as described above, with an external preferably transparent plastic cover or disk that serves to isolate the moving parts of the exerciser, preventing possible injuries to the user or others nearby.

The above-mentioned exclusive and novel features of the exercise and amusement device of this invention dramatically multiply the number of beneficial workouts that can be performed. The sustained enjoyment derived while executing exercising with this exerciser and the challenge of becoming more proficient, are powerful motivations to continue using the exerciser longer and more frequently.

The invention also provides for a handheld exercise or amusement device, including a handle adapted to be gripped by a user, at least two weights being at least one of freely rotatably and freely orbitally mounted about an axis, and a plate-like member disposed between the handle and the at least two weights.

The plate-like member may be at least one of fixed and non-rotatably mounted to the handle. The device may further include a support member, wherein the support member is rotatably mounted to the handle. The device may further include a support member, wherein the support member is at least one of fixed and non-rotatably mounted to the handle. The device may further include a support member, wherein the at least two weights are coupled to the support member via at least one tension member. The at least one tension member may include a flexible tension member. Each of the at least two weights may include a sphere. The device may further include at least one flexible tension member for coupling each of the at least two weights to the device. The plate-like member may include a protective disk. The device may further include a support member, an axial member rotatably mounted to the support member, and the handle being fixed to the support member, wherein the at least two weights are coupled to the axial member via at least one tension member. Each of the at least two weights may include a sphere. The device may further include a mechanism for securing a portion of the at least one tension member to the axial member. The device may further include at least one retaining mechanism, wherein the at least one retaining mechanism is adapted to axially retain the handle on the support member. The at least one retaining mechanism may include at least one washer and at least one nut. The handle may include at least one of a soft and high friction gripping surface. The plate-like member may include a first disk and also include at least one of a second disk and a cover arranged on a side of the at least two weights opposite the handle.

BRIEF DESCRIPTION OF THE DRAWINGS

The present invention is further described in the detailed description which follows, with reference to the plurality of drawings by way of non-limiting examples of preferred embodiments of the present invention. In the drawings, like reference numerals represent similar parts throughout the several views of the drawings, and wherein:

FIG. 6 shows a top view of a central support member utilized in the device shown in FIGS. 1 and 2;

FIG. 7 shows a side view of the support member shown in FIG. 6;

FIG. 8 shows a side view of the handle used in the device shown in FIGS. 1 and 2;

FIG. 22 shows a top view of the handle used in the device shown in FIGS. 15 and 16;

FIG. 23 shows a side view of the handle shown in FIG. 22;

FIG. 24 shows a bottom view of the handle shown in FIG. 22;

FIG. 29 shows a top view of the handle used in the device shown in FIG. 25;

FIG. 30 shows a side view of the handle shown in FIG. 29;

FIG. 31 shows a bottom view of the handle shown in FIG. 29;

DETAILED DESCRIPTION OF THE PRESENT INVENTION

The particulars show herein are by way of example and for purposes of illustrative discussion of the embodiments of the present invention only and are presented in the cause of providing what is believed to be the most useful and readily understood description of the principles and conceptual aspects of the present invention in no more detail than is necessary for the fundamental understanding of the present invention, the description taken together with the drawings making apparent to those skilled in the art how the several forms of the present invention may be embodied in practice.

Figure 1:
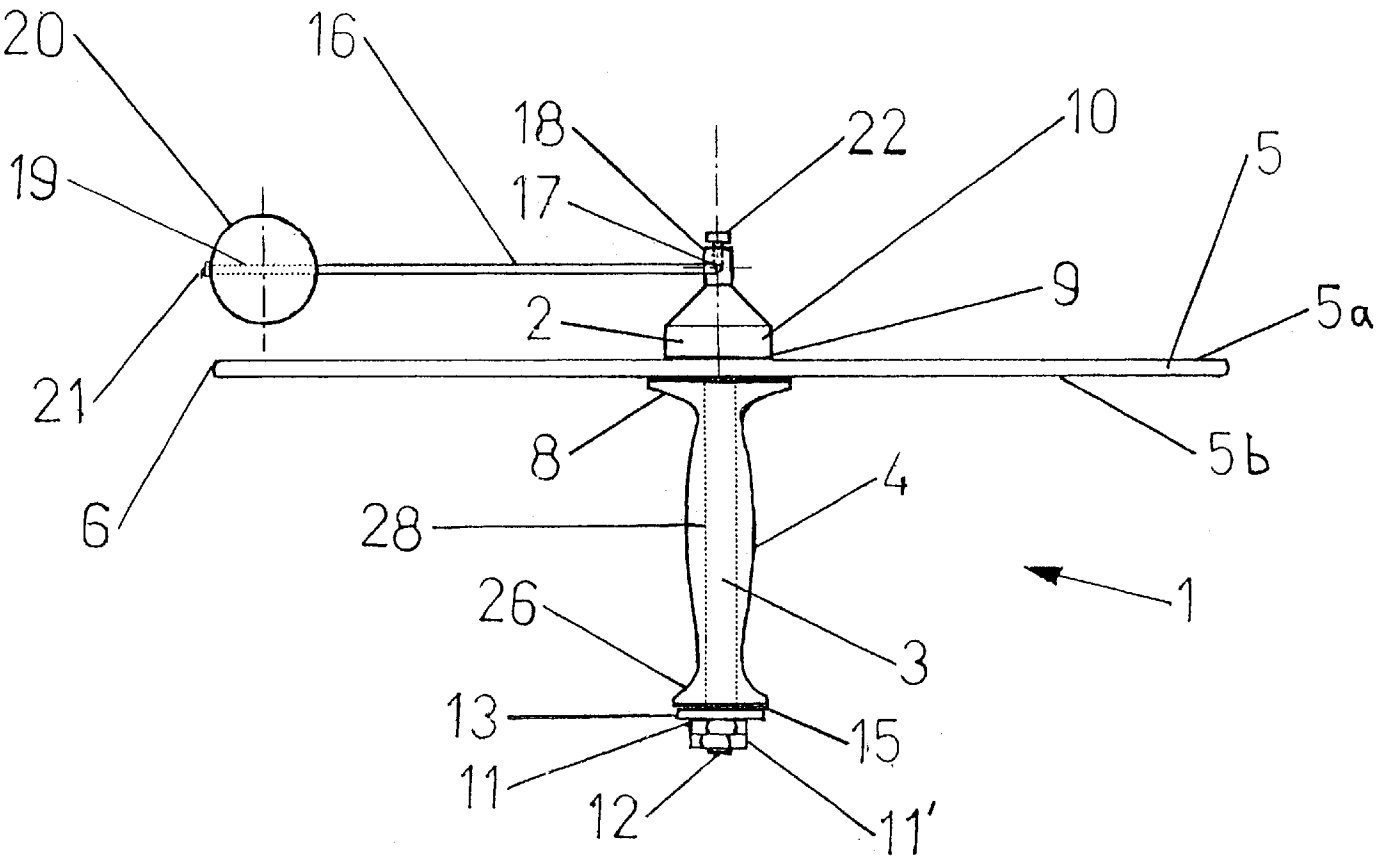
FIG. 1 shows a side view of the exercise and/or amusement device in which a pair of spherical weights orbit about a central handle with a protective disk separating the weights from the handle.

FIG. 1 illustrates an embodiment of an exercise/amusement device according to the present invention. Exerciser 1 includes a centrally located support member 2 which forms a mounting axis for a pair of orbiting and/or rotating spherical weights 20. Each spherical weight 20 is rotatably mounted to the support member 2 via a tension member 16 which may be a flexible tension member. A handle 4 is mounted onto a shaft portion 3 of the support member 2. This mounting is such that the handle 4 can rotate with respect to the shaft 3 and/or the support member 2. A protective disk or plate 5 is arranged between the spherical weights and handle 4 so as to prevent the weights from injuring the user's hand, when the user grips the handle 4.

Figure 2:
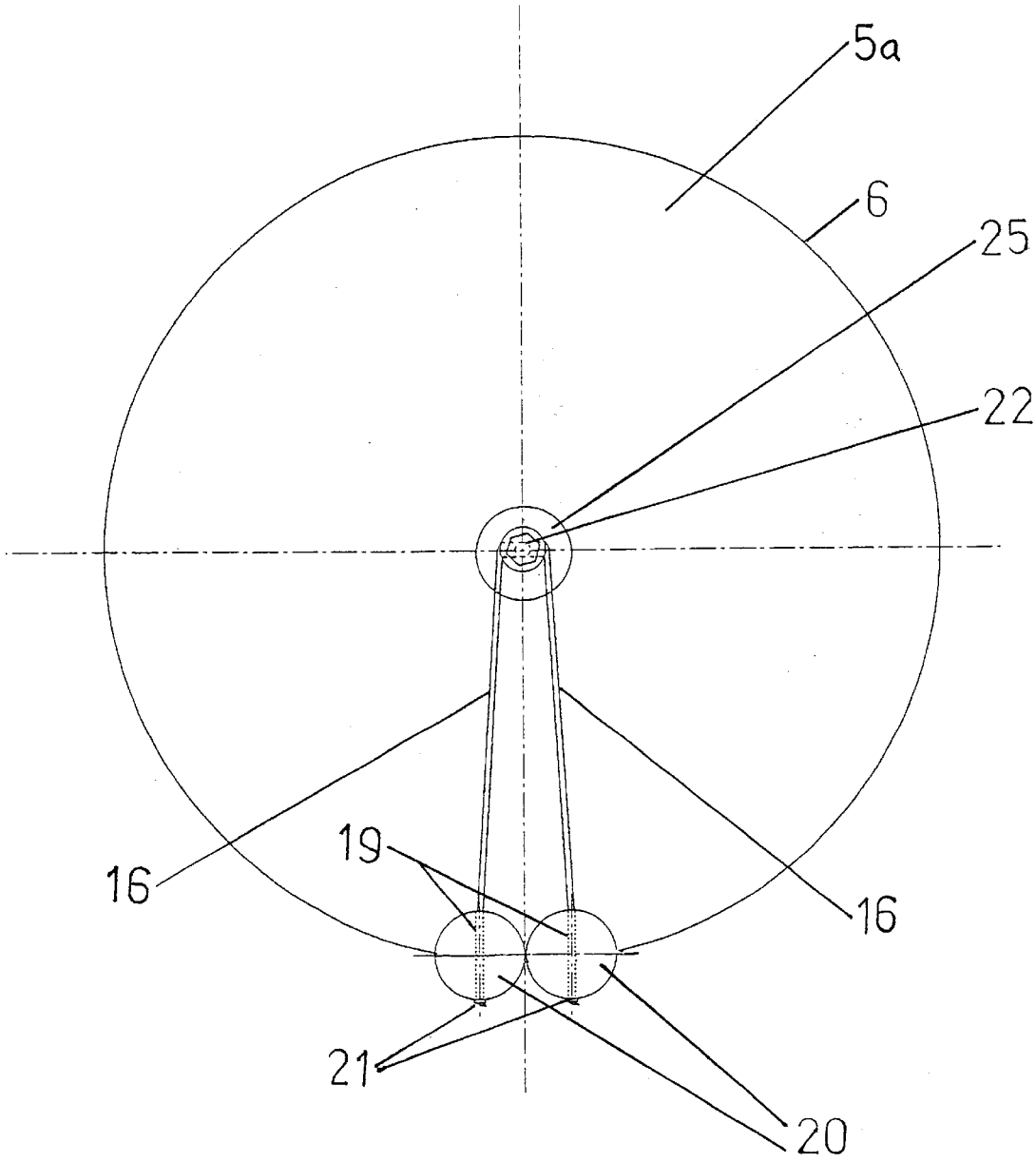
FIG. 2 shows a top view of the device shown in FIG. 1 in which the pair of spherical weights are shown contacting one another.
Figure 3:
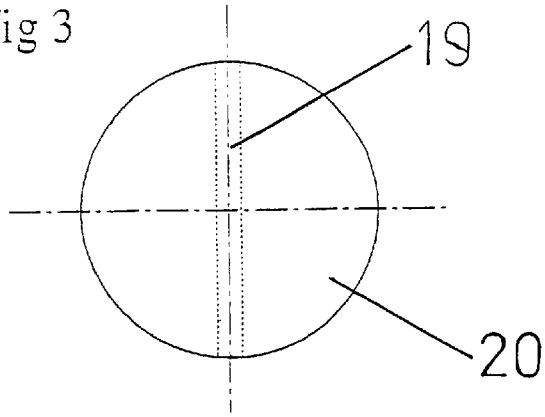
FIG. 3 shows a side view of one of the spherical weights of the device shown in FIGS. 1 and 2.

With reference to FIG. 3, it can be seen that each spherical weight 20 includes a through opening 19 which is sized to receive an end of the tension member 16. The spherical weights 20 may have a smooth outer surface or one which is textured like that of, e.g., a golf ball, with the smooth surface being preferred. It should be noted that the pair spherical weights (see FIG. 2) should preferably have the same spherical diameter. However, the invention is not limited to the use of two spherical weights 20 of the same size. Accordingly, more that two weights 20 may be provided, and the spherical weights 20 may be have different sizes without departing from the scope of the invention. It is also preferred that the spherical weights 20 be made of plastic or synthetic material, which may be either a hard plastic or a soft and/or rubbery plastic. However, it should be noted that the spherical weights 20 may be made of any desired material, conventional or otherwise, which is suitable for its intended purpose such as, e.g., aluminum, composites, and/or including any material which includes reinforcing. If plastic is utilized, the spherical weights 20 may be made using an injection molding process, which is known to produce such shapes efficiently and inexpensively. Of course, other methods of manufacturing such spheres, conventional or otherwise, may be utilized without departing from the scope of the invention.

The spherical weights 20 are, of course, designed to contact one another through impact, and should therefore be designed to sustain continuous and prolonged impacting without being destroyed or otherwise strained. Thus, a synthetic material such as, e.g., acrylic, is preferred.

Figure 4:
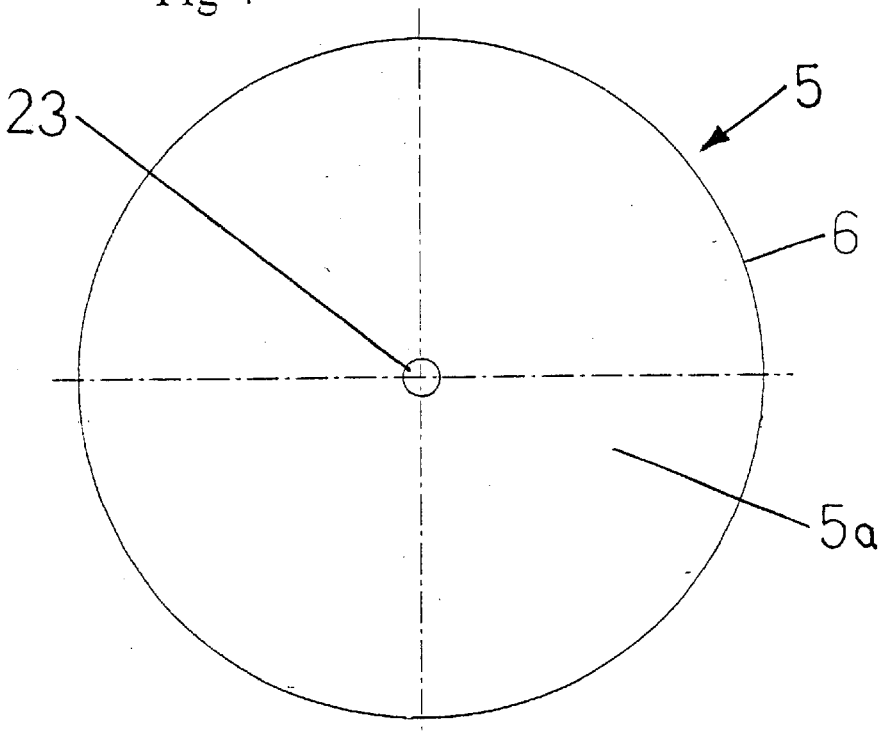
FIG. 4 shows a top view of the protective disk of the device shown in FIGS. 1 and 2.
Figure 5:
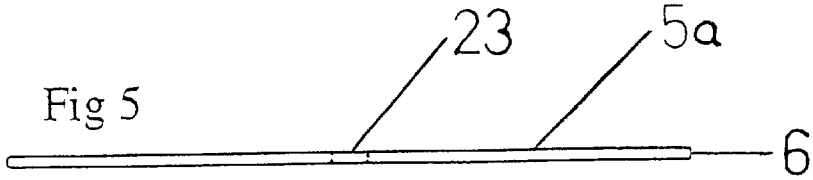
FIG. 5 shows a side view of the protective disk shown in FIG. 4.

With reference to FIGS. 4 and 5, it can be seen that the protective disk 5 includes a central through opening 23 which is sized to receive a support shoulder portion 7 of the support member 2 (note FIG. 7). The disk 5 is a plate-like member that has an upper surface 5*a* which faces the orbiting spheres 20 and a lower surface 5*b* which faces the handle 4. The disk 5 also has an outer edge 6 which is preferably rounded or otherwise rendered blunt, so as not to injure the user or those persons in the vicinity of the user. It should be noted that the protective disk 5 should preferably have a circular shape which is equal to (see e.g., FIGS. 1 and 11) or greater than an overall orbiting diameter of the spheres 20. However, the invention also contemplates that the disk 5 may have a diameter which is smaller than the overall orbiting diameter of the spheres 20 (see e.g., FIGS. 2, 9 and 10). Moreover, the invention is not limited to the use of a single protective disk 5 or to one that is circular. Accordingly, more that one disk 5 may be provided (e.g., another disk 29' may be arranged above the spheres 20 as shown in FIG. 12) and the disks 5 and 29' may have different diameters (see FIG. 12) and shapes (not shown) without departing from the scope of the invention. It is also preferred that the disk 5 be made of plastic or synthetic material, which may be a hard plastic that may be colored and/or transparent or translucent. However, it should be noted that the disk 5 may be made of any desired material, conventional or otherwise, which is suitable for its intended purpose such as, e.g., aluminum, composites, and/or including any material which includes reinforcing. If plastic is utilized, the disk 5 may be made using an injection or press molding process, which is known to produce such flat shapes efficiently and cheaply. Of course, other methods of manufacturing such disks, conventional or otherwise, may be utilized without departing from the scope of the invention.

The disk 5 is, of course, designed to prevent the spherical weights 20 from accidentally injuring the user, and should therefore be designed to sustain continuous and prolonged impacting or frictional wearing from the spheres 20 without being destroyed or otherwise strained or worn by such impacting or wearing. Thus, a synthetic material is preferred. Finally, the invention also contemplates that the upper surface 5*a* of the disk 5 may include a wear resistant and/or impact resistant surface and/or coating (not shown).

With reference to FIGS. 6 and 7, it can be seen that the support member 2 includes an upper portion 10, 25 and 18, a lower shaft portion 3 and 12, and a shoulder portion 7 disposed therebetween. The shoulder portion 7 has a diameter that is sized to enter into the central opening 23 of the disk 5. The shoulder portion 7 also has an axial width which approximates the width if the disk 5, measured between the upper surface 5*a* and the lower surface 5*b*. The support member 2 is an elongated rod-like member and includes an upper shoulder surface 9 which faces the upper surface 5*a* of the disk 5. A cylindrical portion 10 of the support member 2 is designed to extends above the upper surface 5*a* (see FIG. 1) of the disk 5. The cylindrical surface 10 terminates at the beginning of a tapered portion 25 of the support member 2, and a cylindrical holding portion 18 extends above the tapered portion 25. The holding portion 18 further includes an axial opening 24, whose purpose will be described hereinafter, that has internal threads which are configured to accept and/or mate with external threads of a threaded axial member 22 (see FIG. 1). The holding portion 18 also includes a side and/or radial through opening 17 which is designed and/or sized to accept the tension member(s) 16 (see FIGS. 1 and 2). The support member 2 also has a shaft portion 3 which extends downwardly from the support shoulder 7. The shaft portion 3 includes a cylindrical surface and/or diameter which is sized to fit within a cylindrical through opening 28 in the handle 4 (see FIG. 8). Terminating the opposite end of the shaft portion 3 is an externally threaded end 12 whose external threads are configured to accept and/or mate with internal threads of two nuts 11 and 11', with an inner nut 11 being designed to force a washer 13 against shoulder 14 of the shaft portion 3 and an outer nut 11' being designed as a lock-nut, i.e., a nut 11' which prevents nut 11 from backing out or loosening. An outside diameter of the external threaded portion 12 is accordingly sized to fit within a through opening (not shown) in a washer 13 (see FIG. 1).

However, the invention is not limited to the use of a single piece or integral support member 2, and such support member 2 may include various individual portions which are joined together by any coupling method, conventional or otherwise. Moreover, the various portions shown may have different diameters, shapes, and/or relative proportions without departing from the scope of the invention. Thus, the shaft portion 3 may be shorter or longer in comparison to, e.g., cylindrical portion 10. It is preferred that the support member 2 be made of plastic or synthetic material, which may be either a hard plastic which may be colored and/or it may be transparent or translucent. However, it should be noted that the support member 2 may be made of any desired material, conventional or otherwise, which is suitable for its intended purpose such as, e.g., any metal such as aluminum, composites, and/or including any material which includes reinforcing. If plastic is utilized, the support member 2 may be made using an injection molding process, which is known to produce such shapes efficiently and cheaply. Of course, other methods of manufacturing such rod-like members (e.g., machining), conventional or otherwise, may be utilized without departing from the scope of the invention.

The support member 2 is, of course, designed to radially and/or rotatably support the pair of spherical weights 20 as well as the handle 4, and should therefore be designed to sustain continuous and prolonged bending or frictional wearing from each of the spheres 20 and the handle 4 without it being destroyed or otherwise strained or worn by such bending or wearing. Thus, a rigid wear resistant synthetic material is preferred.

With reference to FIG. 8, it can be seen that the handle 4 includes an upper portion 8, a lower portion 26, and a middle grip portion 33 disposed there between. The upper portion 8 has an outer diameter which is larger than the lower portion 26 and includes an upper surface 27 which faces the bottom surface 5*b* of the disk 5 (see FIG. 1). The lower portion 26 has an outer diameter which is smaller than the upper portion 8 and includes a lower surface 15 which faces the washer 13 (see FIG. 1). The overall length of the handle 4 measured from upper surface 27 to the lower surface 15, is designed to be approximately equal to or slightly smaller than a length between surface 34 beneath shoulder portion 7 and shoulder 14 of the support member 2. The handle 4 is an elongated spool-like member and includes a bulging or dual tapered middle portion 33 which is adapted to be ergonomically gripped by a user's hand. The handle 4 further includes an axial cylindrical through opening 28 which is sized and/or configured to accept the shaft portion 3 of the support member 2 (see FIG. 1). The overall length of the handle 4, as well as the diameter of opening 28, is such that the handle 4 is free to rotate with respect to the support member 2. As can be seen in FIG. 1, the handle 4 is designed to be axially restrained on the shaft portion 3 of the support member 2 between the washer 13 and the shoulder 34 of the support member 2.

However, the invention is not limited to the use of a single piece or integral handle 4 of the kind shown, and such handle 4 may include a different shape and/or may be formed as two or more individual portions which are joined together by any coupling method, conventional or otherwise. Moreover, the various portions may have different diameters, shapes, and/or relative proportions without departing from the scope of the invention. Thus, the handle 4 may be formed from, e.g., a series of rings or a stack of washers having different diameters. It is also preferred that the handle 4 be made of plastic or synthetic material which is textured to aid in gripping. The handle 4 may be made of either a hard plastic or soft rubber like plastic, and may be colored and/or made transparent or translucent. However, the handle 4 may also be made of any desired material, conventional or otherwise, which is suitable for its intended purpose such as, e.g., any metal such as aluminum, composites, and/or including any material which includes reinforcing. If plastic is utilized, the handle 4 may be made using an injection molding process, which is known to produce such shapes efficiently and cheaply. Of course, other methods of manufacturing such spool-like members, conventional or otherwise, may be utilized without departing from the scope of the invention.

The handle 4 is, of course, designed to allow the user to grip the device 1 in order to rotatably support the pair of spherical weights 20 via the support member 2, and should therefore be designed to sustain continuous and prolonged bending or frictional wearing from each of the shoulder 34, washer 13 and shaft portion 3 without it being destroyed or otherwise strained by such bending or wearing. Thus, a soft, but wear resistant synthetic material is preferred.

Referring back to FIGS. 1 and 2, the invention will now be more particularly described. Each of spherical weights 20 is connected and/or secured to the device via a corresponding tension member 16. This connection may be a simple design wherein one end of the tension member 16 passes through the opening 19 of each sphere 20, with its end forming a retaining knot 21. The other end of each tension member 16 is secured and/or fixed to the holding member 18 via the axial retaining member or bolt 22. According to a simple construction of the invention, a single tension member 16 is utilized with its two extended ends having a sphere 20 affixed thereto and with its middle portion being fixed to the holding member 18. According to this design, the bolt 22 is threaded into the opening 24 until the tension member 16 is compressed to such an extend that it cannot slide or otherwise move within the radial opening 17 of the holding portion 18. Of course, if a single tension member 16 is utilized as is shown if FIG. 2, it goes without saying that the bolt 22 must engage substantially the exact middle of the tension member 16 so that the two spheres 20 will orbit and/or rotate equally distantly from the holding portion 18 and/or axis.

However, the invention also contemplates that two tension members 16 may be utilized, such that one end of each tension member 16 is fixed to a sphere 20 and another end of each is fixed to the holding portion 18. The invention further contemplates that the tension member(s) 16 and the sphere(s) 20 may be formed unitarily and in one piece of the same material, which would not require the knots 21. However, it is preferred that tension member 16 be made of an inexpensive but durable string, such as e.g., a cotton or nylon string. However, any convenient flexible tension member 16 may be utilized such as a wire, cord, cable, chain, etc, and such may be made of any material (e.g., a metal or a synthetic material), conventional or otherwise, that is suitable for its intended purpose. The invention further contemplates that the tension member(s) 16 can be made adjustable in length and/or can be formed of materials with limited elongation, and further contemplates that the materials may have significant elastic elongation. However, it is preferred that the tension members(s) 16 have limited elongation, so that the spheres 20 do not project significantly beyond the outer diameter/edge 6 of the disk 5.

It should be apparent to one skilled in the art how the Exerciser 1 shown in FIG. 1 may be assembled. Accordingly, its assembly will only briefly be described. The first step involves sliding the disk 5 onto shaft portion 3 of the support member 2 until opening 23 fits onto shoulder 7. Then, the handle 4 may be slid onto the shaft 3 until upper surface 27 engages surface 34. The washer 13 and nuts 11, 11' may then be installed over threaded portion 12 and tightened. Next, the tension member 16 may be slid through opening 17 and its ends further slid into openings 19 in each sphere 20 and knotted 21. Finally, a substantially exact middle portion of the tension member 16 is determined and the bolt 22 is tightened. The result is a device 1 in which the pair of spheres rotate and/or orbit about holding portion 18 and contact/impact one another when the device 1 is caused to move, such as when it is used for exercising and/or amusement. As can be seen in FIG. 2, this contact occurs when the pair of spheres meet.

Figure 11:
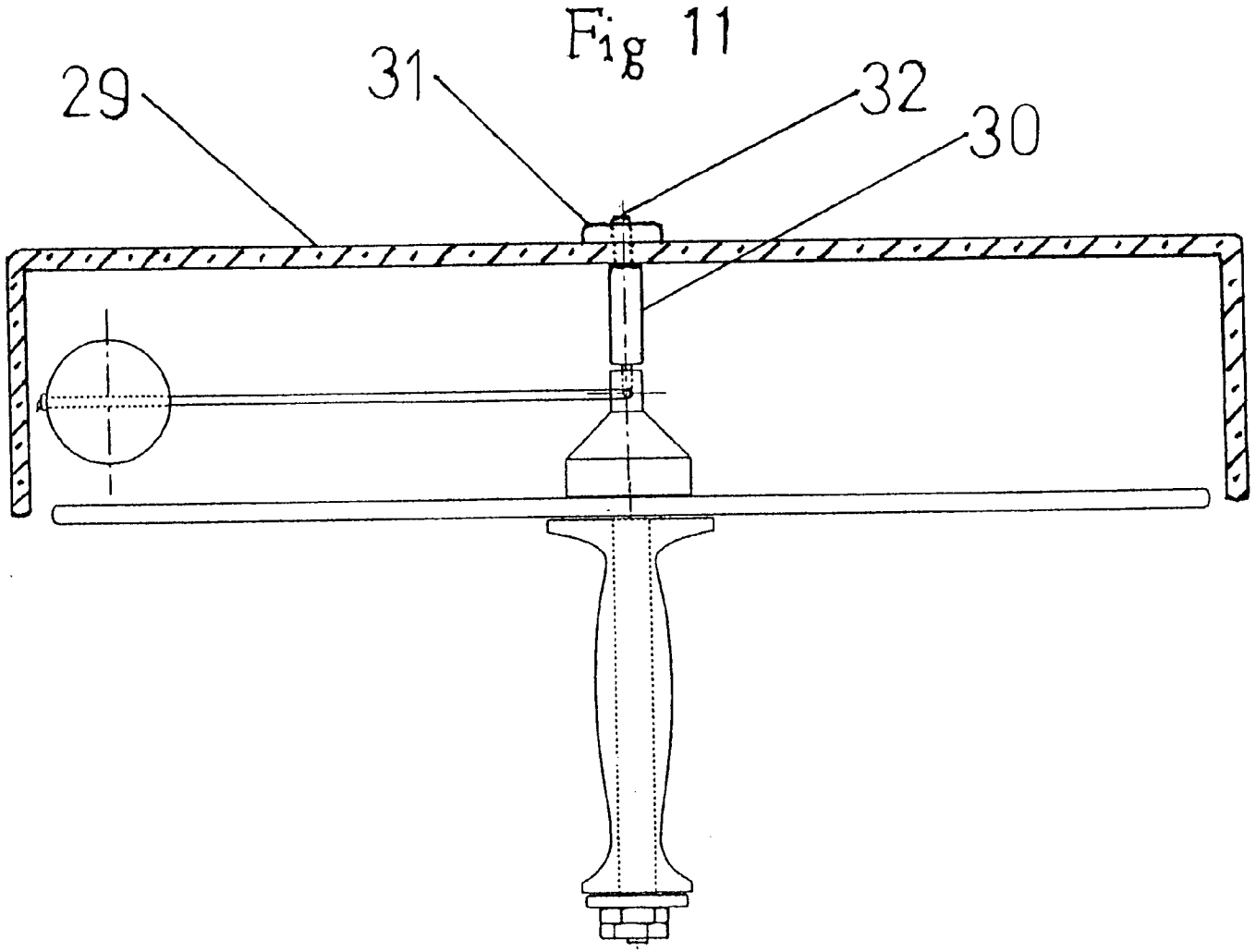
FIG. 11 shows a side view of another embodiment of the device. This embodiment differs from the embodiment shown in FIG. 1 in that in utilizes a transparent or translucent protective and/or removable cover to protect the user and those around the user from possible injury from the weights.
Figure 12:
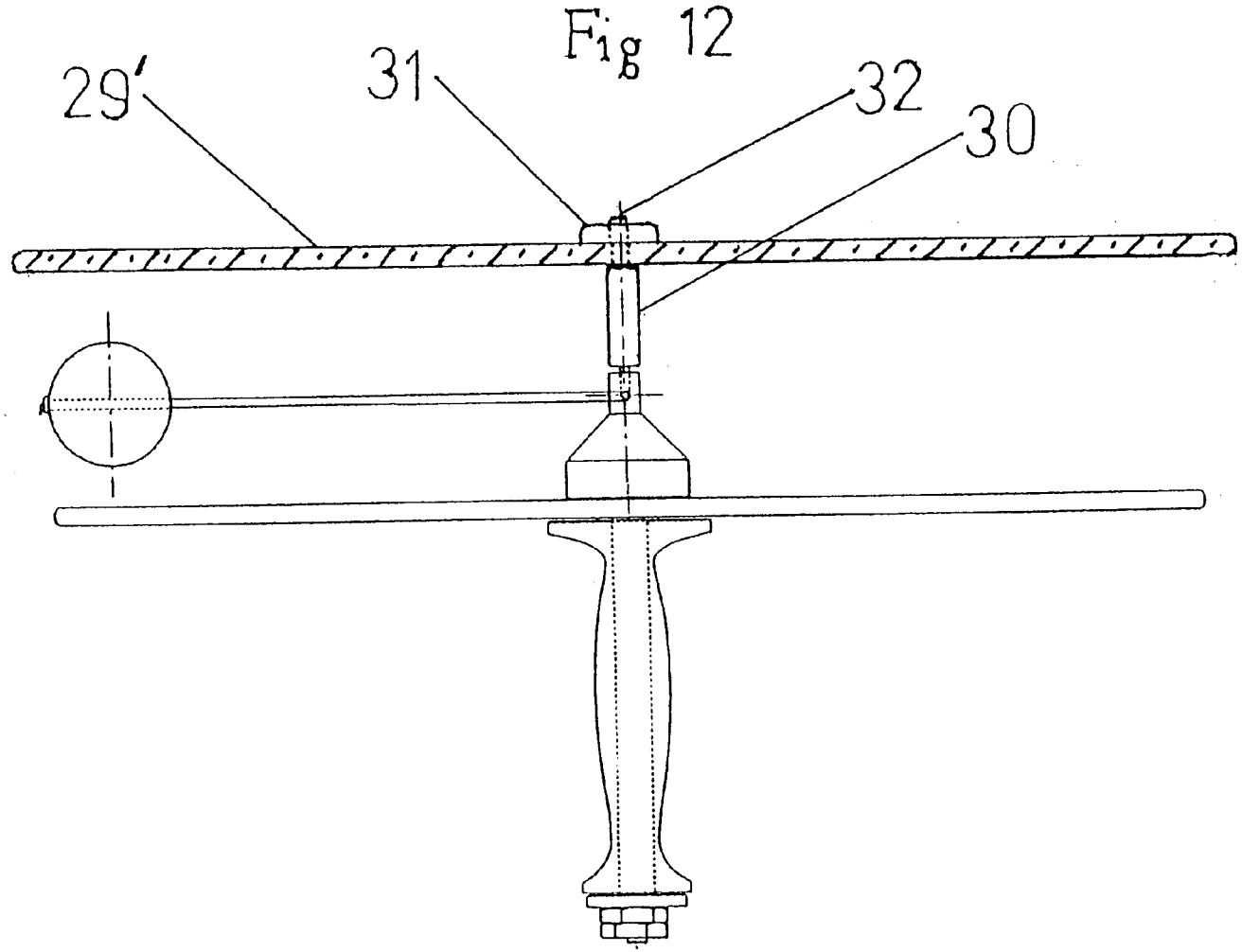
FIG. 12 shows a side view of still another embodiment of the device. This embodiment differs from the embodiment shown in FIG. 1 in that in utilizes a transparent or translucent protective and/or removable disk to protect the user and those around the user from possible injury from the weights.

Another advantageous embodiment of the exercise/amusement device is shown in FIG. 11. This embodiment is characterized as having many similar features to the embodiment just described, except that it also includes a cover 29 to protect the spheres 20 and/or to protect the user and those in the vicinity of the user from the spheres 20. The cover 29 may be removably mounted to the device 1 via a fixing nut 31 which threadably engages a two ended bolt 30. This bolt 30 is similar to the bolt 22 of FIG. 1, except that it has an elongated middle part and a second externally threaded end 32 which engages internal threads of the nut 31. However, it should be noted that the invention also contemplates attaching the cover 29 to the device 1 using any other convenient attachment mechanism, conventional or otherwise.

The cover 29 may be made of a natural or synthetic plastic, and may be colored and/or made transparent or translucent. The cover 29 may also be made of any desired material, conventional or otherwise, which is suitable for its intended purpose such as, e.g., any metal such as aluminum, composites, and/or including any material which includes reinforcing. If plastic is utilized, the cover 29 may be made using an injection or press molding process, which is known to produce such shapes efficiently and cheaply. Of course, other methods of manufacturing such bowl-like members, conventional or otherwise, may be utilized without departing from the scope of the invention.

Still another advantageous embodiment of the exercise/amusement device is shown in FIG. 12. This embodiment is characterized as having many similar features to the embodiment shown in FIG. 1, except that this embodiment also includes a second disk 29' to protect the spheres 20 and/or to protect the user and those in the vicinity of the user. The second disk 29' may be removably mounted to the device 1 via a fixing nut 31 which threadably engages a two ended bolt 30, as was already described with reference to FIG. 11. As with the cover 29 in FIG. 11, the invention contemplates attaching the second disk 29' to the device using any other convenient mechanism, conventional or otherwise.

The second disk 29' may be made of a natural or synthetic plastic, and may be colored and/or transparent or translucent. However, the second disk 29' may also be made of any desired material, conventional or otherwise, which is suitable for its intended purpose such as, e.g., any metal such as aluminum, composites, and/or including any material which includes reinforcing. If plastic is utilized, the disk 29' may be made using an injection or press molding process, which is known to produce such shapes efficiently and inexpensively. Of course, other methods of manufacturing such plate-like members, conventional or otherwise, may be utilized without departing from the scope of the invention.

The devices shown may be inexpensively made if the spheres 20 and the disks 5, 29' and cover 29 are made of an acrylic type plastic which is transparent and durable. The support member 2 and bolts 22, 30, washer 13, and the nuts 11, 11', and 31 may also be made of a hard plastic, and the tension member 16 may be a cotton string.

Figure 9:
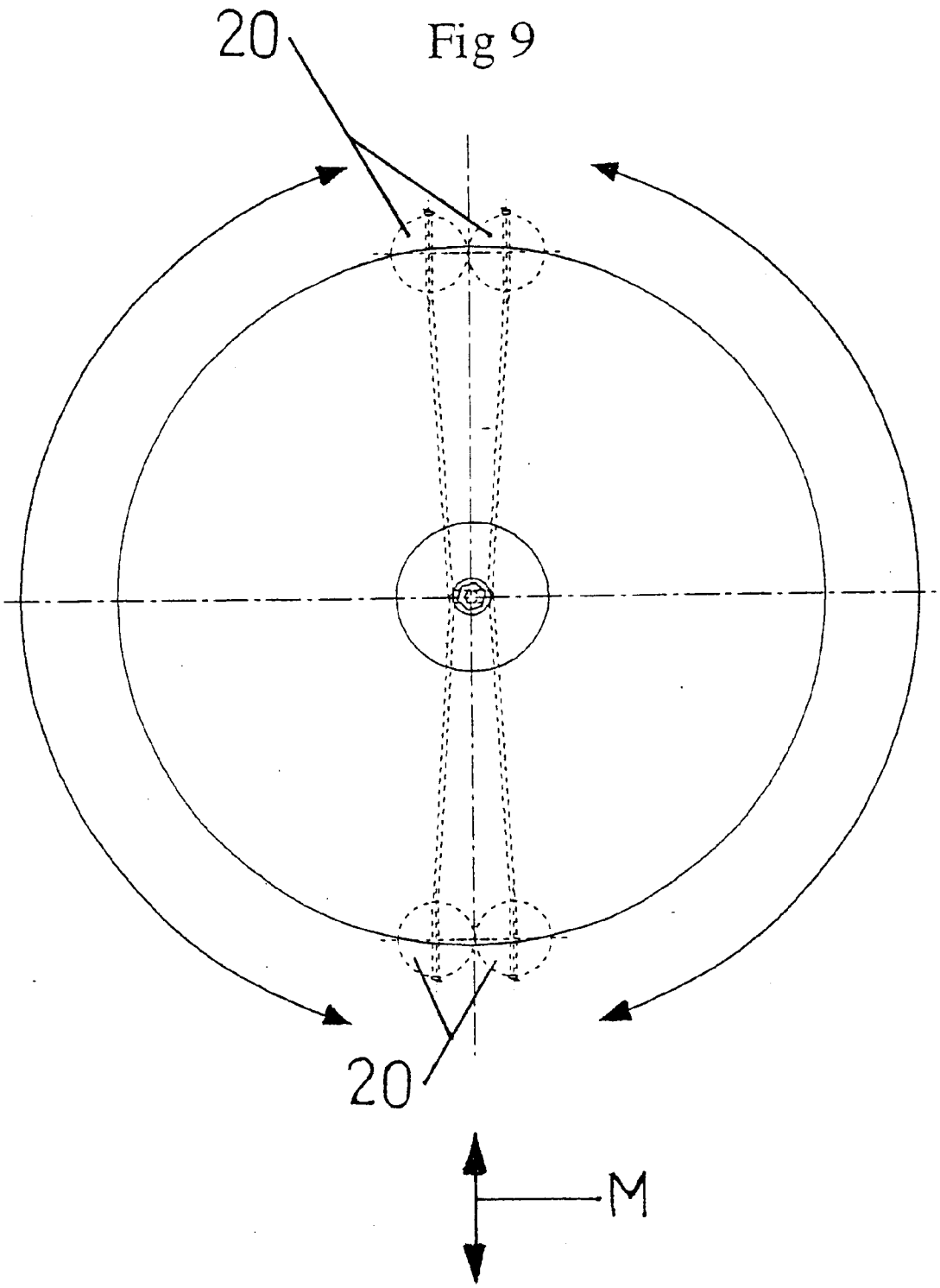
FIG. 9 shows a top view illustrating one way the device can be used and/or moved to cause the weights to contact one another at various positions. In this case, linear movement M causes the pair of weights to contact each other at twelve o'clock and at six o'clock.
Figure 10:
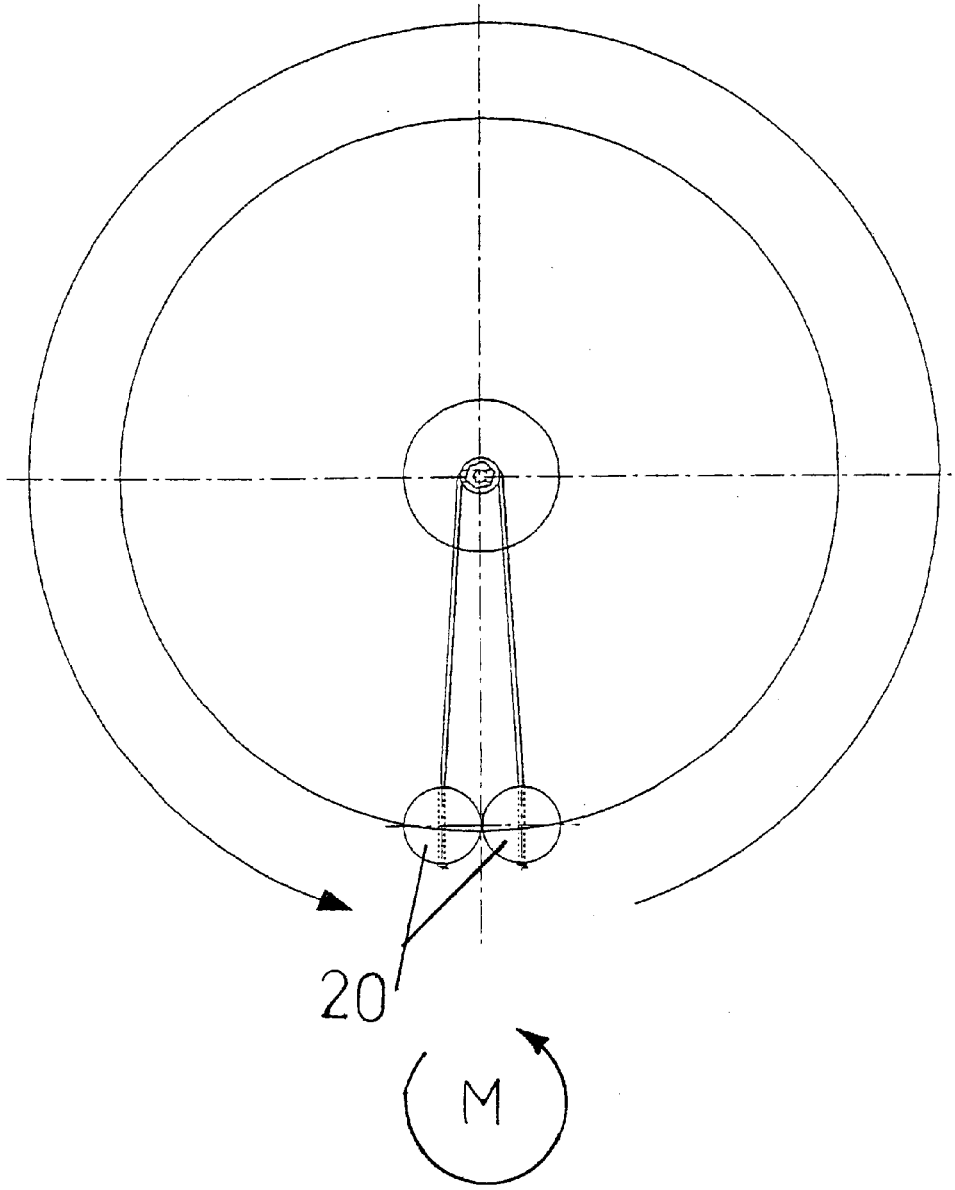
FIG. 10 shows a top view illustrating another way the device can be used and/or moved to cause the weights to contact one another at one position and also rotate together about the handle. In this case, rotational movement M causes the pair of weights contact each at the six o'clock position and thereafter rotate together.
Figure 13:
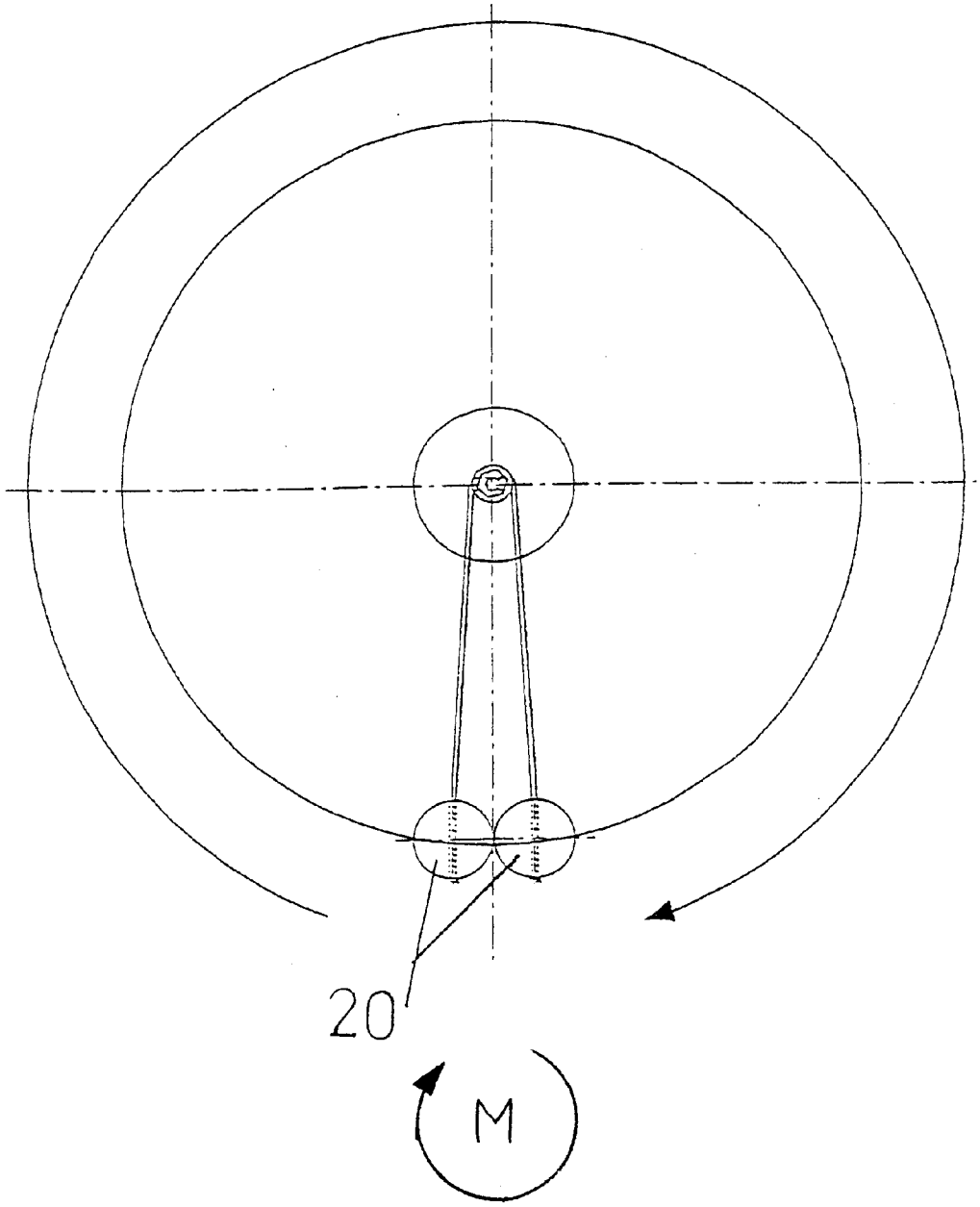
FIG. 13 shows a top view illustrating another way the device can be used and/or moved to cause the weights to contact one another at various positions. In this case, curvilinear and/or circular movement M causes the pair of weights to contact each other at six o'clock so that they can rotate together in the direction indicated by the arrow.
Figure 14:
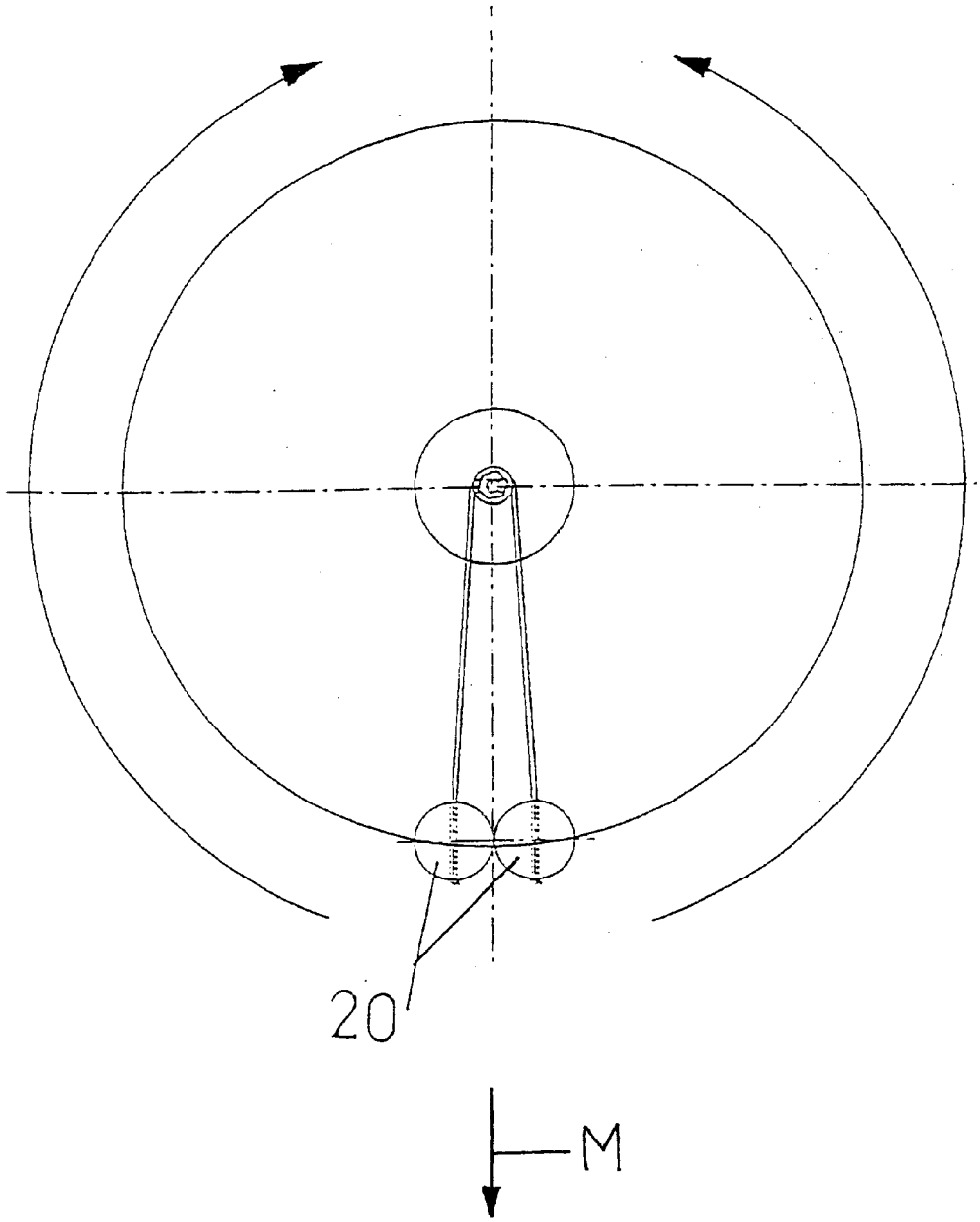
FIG. 14 shows a top view illustrating still another way the device can be used and/or moved to cause the weights to contact one another at one position, i.e., movement M in a single direction from the six o'clock position will tend to cause the pair of weights to rotate in an opposite direction of movement M to contact each at the twelve o'clock position.

Turning now to the operation of the exercise/amusement device shown in FIGS. 1–12, the user can grasp or grip the handle 4 with either or both of his hands. Next, the user imparts to the device 1*a* movement which may be in any number of directions such as, e.g., substantially vertical, horizontal, linear, curvilinear, or circular reciprocating motion, or any combination thereof. However, it is preferred that the movement be in any plane which is perpendicular to an axis running through the handle 4/support member 2. Thus, this movement M may be linear as shown in FIGS. 9 and 14. Moreover, a substantially orbital, curvilinear, or circular continuous motion or movement M can also be imparted to the exercise/amusement device 1 as shown in FIGS. 10 and 13. Depending on the motion imparted to the device 1, the weights or spheres 20 coupled to the holding portion 18 are caused to move with a circular reciprocating motion and eventually collide with one another at the end of each half cycle or move together with a circular continuous motion. Accordingly, such motion gives the user of the device 1*a* unique exercise and/or amusement experience which is different from that of conventional exercise or amusement devices.

The user may also place a exerciser in each hand and execute either the same movement M with each hand or different movements with each hand. Moreover, the movements M may be preestablished so that the user can complete an exercise or amusement routine or purely random movements M in any direction. Additionally, the user may perform any number of these movements alone or in the company of other users in either a coordinated effort or with each user being allowed to perform their movements randomly.

Figure 15:
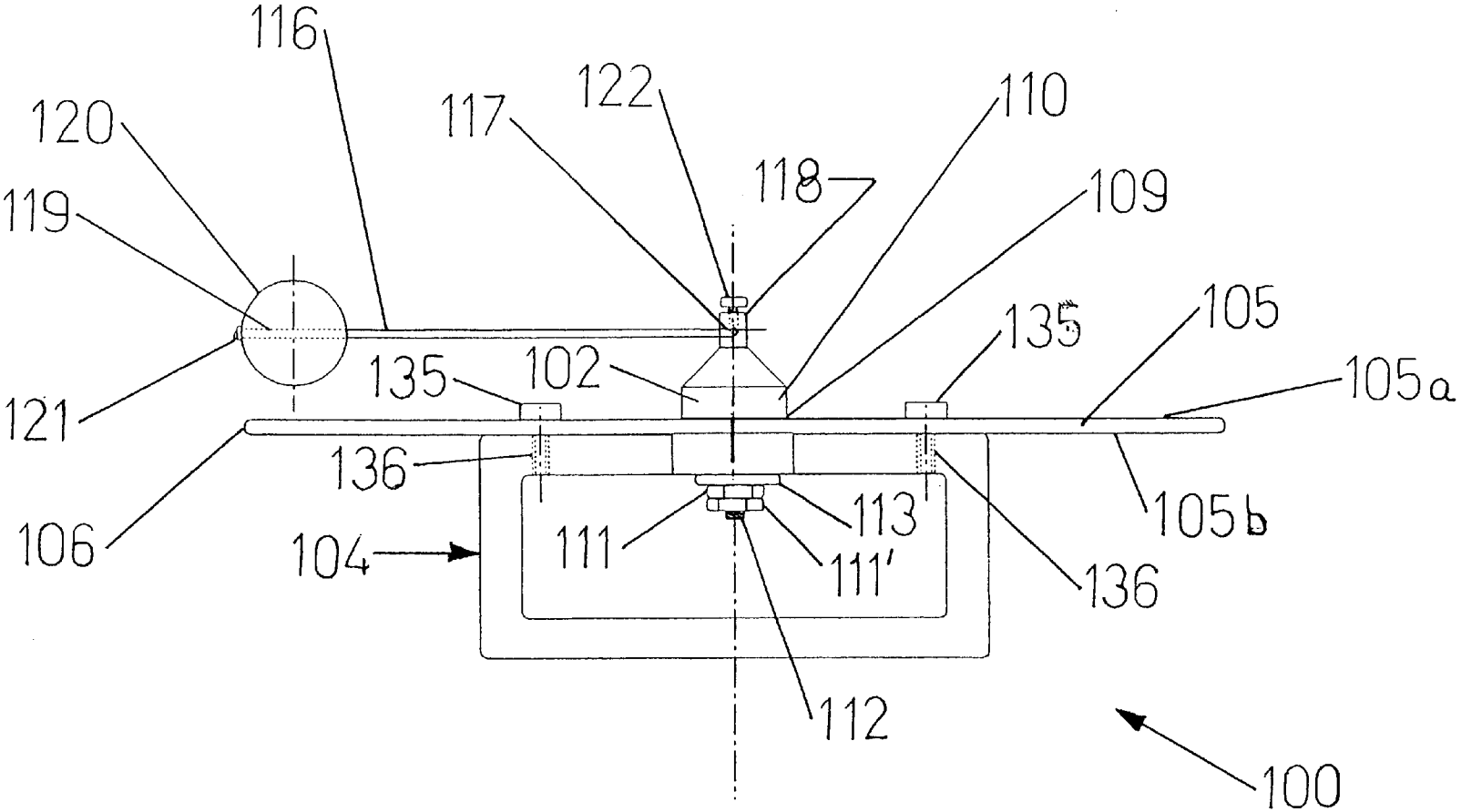
FIG. 15 shows a side view of another exercise and/or amusement device in which a pair of spherical weights orbit about a handle with a protective disk separating the weights from the handle.
Figure 16:
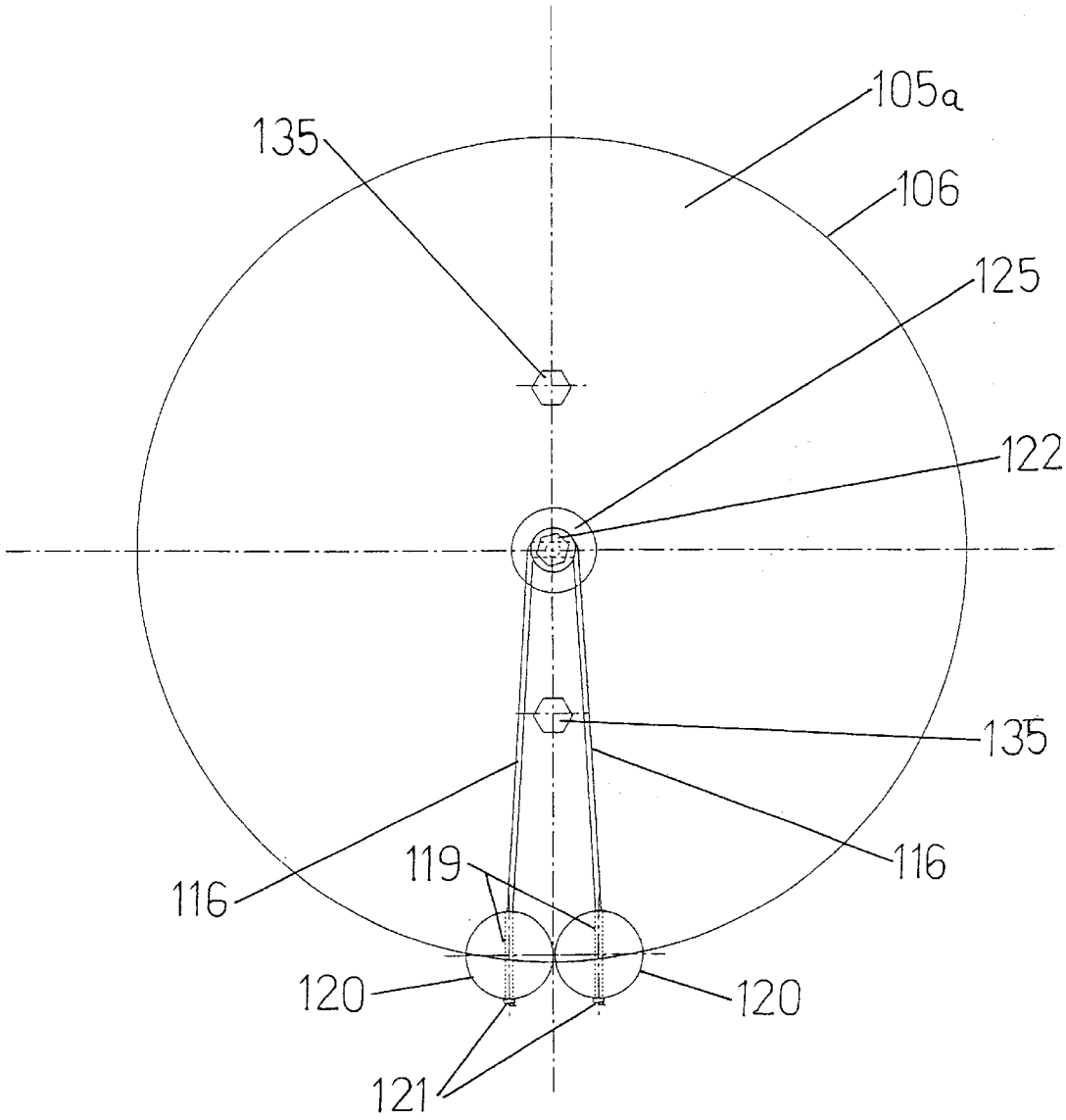
FIG. 16 shows a top view of the device shown in FIG. 15 in which the pair of spherical weights are shown contacting one another.

FIGS. 15 and 16 illustrate another embodiment of an exercise/amusement device according to the present invention. Exerciser 100 includes a centrally located support member 102 which forms a mounting axis for a pair of orbiting and/or rotating spherical weights 120. Each spherical weight 120 is rotatably mounted to the support member 102 via a tension member 116 which may be a flexible tension member. A handle 104 is mounted to a shaft shoulder portion 107 of the support member 102. This mounting may be such that the support member 102 can rotate with respect to the handle 104 or the design can be such that support member 102 is made non-rotatable with respect to the handle 104 (i.e., by tightening nuts 111, 111'). A protective disk or plate 105 is arranged between the spherical weights 120 and handle 104 so as to prevent the weights 120 from injuring the user's hand, e.g., such as when the user grips the handle 104.

Figure 17:
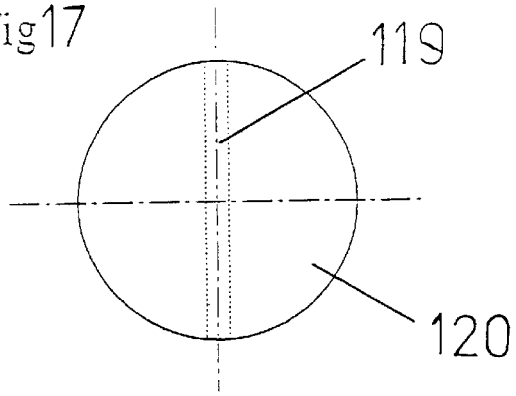
FIG. 17 shows a side view of one of the spherical weights of the device shown in FIGS. 15 and 16.

With reference to FIG. 17, it can be seen that each spherical weight 120 includes a through opening 119 which is sized to receive an end of the tension member 16. The spherical weights 120 are spheres which may have a smooth outer surface or one which is textured like that of, e.g., a golf ball, with the smooth surface being preferred. It should be noted that the pair of spherical weights (see e.g., FIG. 16) should preferably have substantially the same spherical diameter. However, the invention is not limited to the use of two spherical weights 120 and/or those of the same size. Accordingly, more that two weights 120 may be provided and the spherical weights 120 may be have different sizes without departing from the scope of the invention. It is also preferred that the spherical weights 120 be made of wood, metal, ceramic, plastic or synthetic material, which may be either a hard plastic or a soft and/or rubbery plastic. However, it should be noted that the spherical weights 120 may be made of any desired material, conventional or otherwise, which is suitable for its intended purpose such as, e.g., aluminum, composites, and/or including any material which includes reinforcing. If plastic is utilized, the spherical weights 120 may be made using an injection molding process, which is known to produce such shapes efficiently and cheaply. Of course, other methods of manufacturing such spheres, conventional or otherwise, may be utilized without departing from the scope of the invention.

The spherical weights 120 are, of course, designed to contact one another through impact, and should therefore be designed to sustain continuous and prolonged impacting without being destroyed or otherwise strained. Thus, a synthetic material such as, e.g., acrylic, is preferred.

Figure 18:
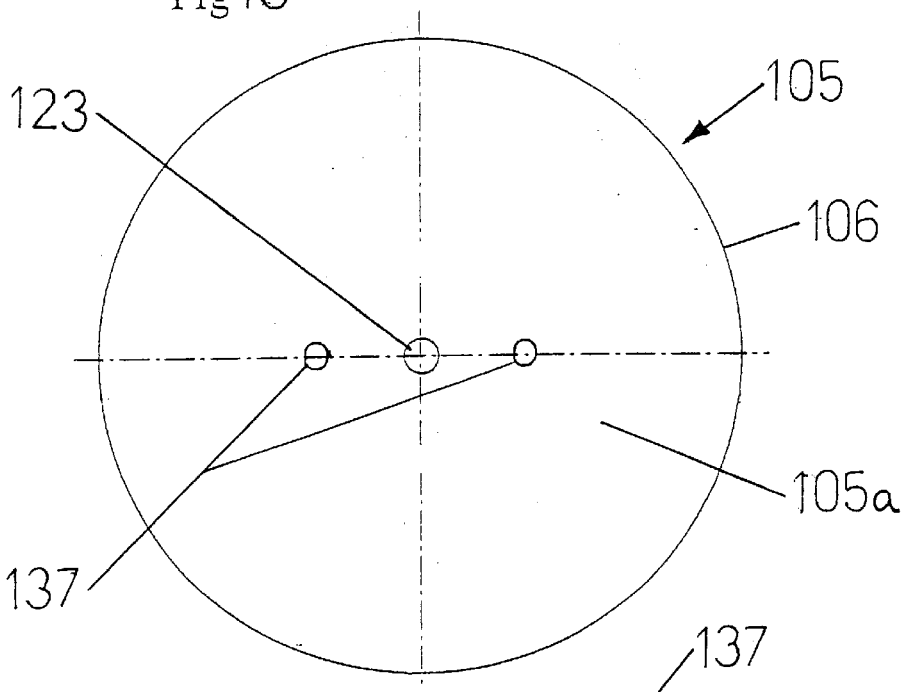
FIG. 18 shows a top view of the protective disk of the device shown in FIGS. 15 and 16.
Figure 19:
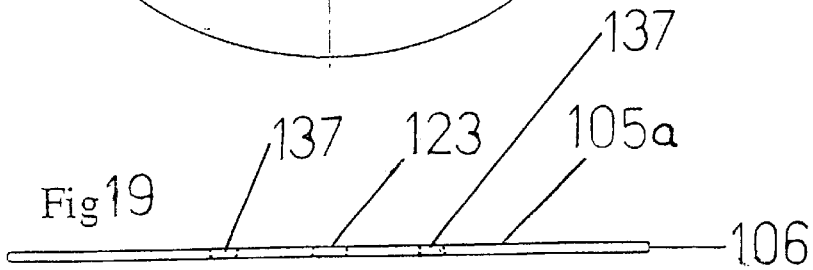
FIG. 19 shows a side view of the protective disk shown in FIG. 18.

With reference to FIGS. 18 and 19, it can be seen that the protective disk 105 includes a central through opening 123 which is sized to receive a support shoulder portion 107 of the support member 102. The disk also includes two through openings 137 which are sized to receive connecting bolts or screws 135. The disk 105 is a plate-like member that has an upper surface 105*a* which faces the orbiting spheres 120 and a lower surface 105*b* which faces the handle 104. The disk 105 also has an outer edge 106 which is preferably rounded or otherwise rendered blunt, so as not to injure the user or those persons in his vicinity. It should be noted that the protective disk 105 should preferably have a circular shape which is equal to (see e.g., FIG. 15) or greater than an overall orbiting diameter of the spheres 120. However, the invention also contemplates that the disk 105 may have a diameter which is smaller than the overall orbiting diameter of the spheres 120 (see e.g., FIG. 16). Moreover, the invention is not limited to the use of a single protective disk 105 or one that is circular. Accordingly, more that one disk 105 may be provided, e.g., another disk 29' may be arranged above the spheres 120 (in a manner similar to that shown in FIG. 12) and the disks 105 and 29' may have different diameters (in a manner similar to FIG. 12) and shapes (not shown) without departing from the scope of the invention. It is also preferred that the disk 105 be made of metal, wood, plastic or synthetic material, which may be a hard plastic that may be colored and/or transparent or translucent. However, it should be noted that the disk 105 may be made of any desired material, conventional or otherwise, which is suitable for its intended purpose such as, e.g., aluminum, composites, and/or including any material which includes reinforcing. If plastic is utilized, the disk 105 may be made using an injection or press molding process, which is known to produce such flat shapes efficiently and inexpensively. Of course, other methods of manufacturing such disks, conventional or otherwise, may be utilized without departing from the scope of the invention.

The disk 105 is, of course, designed to prevent the spherical weights 120 from accidentally injuring the user, and should therefore be designed to sustain continuous and prolonged impacting or frictional wearing from the spheres 120 without being destroyed or otherwise strained or worn by such impacting or wearing. Thus, a synthetic material is preferred. Finally, the invention also contemplates that the upper surface 105*a* of the disk 105 may include a wear resistant and/or impact resistant surface and/or coating (not shown).

Figure 20:
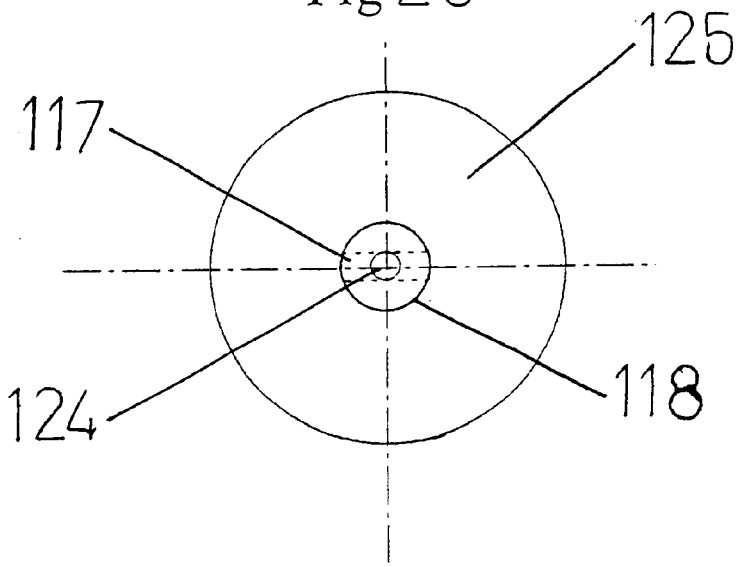
FIG. 20 shows a top view of a central support member utilized in the device shown in FIGS. 15 and 16.
Figure 21:
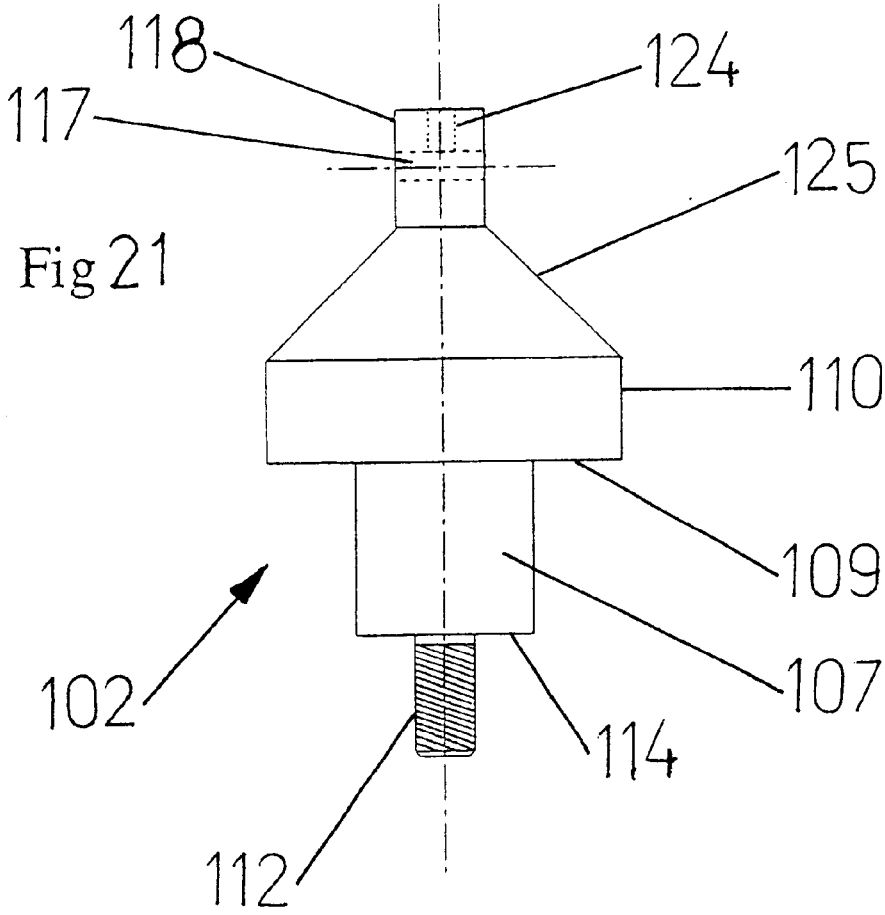
FIG. 21 shows a side view of the support member shown in FIG. 20.

With reference to FIGS. 20 and 21, it can be seen that the support member 102 includes an upper portion 110, 125 and 118, a lower threaded portion 112, and a shoulder shaft portion 107 disposed there between. The shoulder portion 107 has a diameter that is sized to enter into the central opening 123 of the disk 105. The shoulder portion 107 also has an axial width which approximates the width (i.e., the distance between 109 and 114) of the disk 105, measured between the upper surface 105*a* and the lower surface 105*b* plus an axial width of circular portion 139 of handle 104 (measured from surface 127 to surface 115). The support member 102 is an elongated rod-like member and includes an upper shoulder surface 109 which faces the upper surface 105*a* of the disk 105. A cylindrical portion 110 of the support member 102 is designed to extend above the upper surface 105*a* (see FIG. 15) of the disk 105. The cylindrical surface 110 terminates at the beginning of a tapered portion 125 of the support member 102. And a cylindrical holding portion 118 extends above the tapered portion 125. The holding portion 118 further includes an axial opening 124, whose purpose will be described hereinafter, that has internal threads which are configured to accept and/or mate with external threads of a threaded axial member 122 (see FIG. 15). The holding portion 118 also includes a side and/or radial through opening 117 which is designed and/or sized to accept the tension member(s) 116 (see FIGS. 15 and 16). As discussed above, the shaft portion 107 includes a cylindrical surface and/or diameter which is sized to fit within a cylindrical through opening 128 in the handle 104 (see FIG. 22). Terminating the opposite end of the shaft portion 107 is an externally threaded end 112 whose external threads are configured to accept and/or mate with internal threads of two nuts 111 and 111', with an inner nut 111 being designed to force a washer 113 against shoulder 114 of the shaft portion 107 and an outer nut 111' being designed as a lock-nut, i.e., a nut 111' which prevents nut 111 from backing out or loosening. An outside diameter of the external threaded portion 112 is accordingly sized to fit within a through opening (not shown) in a washer 113 (see FIG. 15).

However, the invention is not limited to the use of a single piece or integral support member 102, and such support member 102 may include various individual portions which are joined together by any coupling method, conventional or otherwise. Moreover, the various portions shown may have different diameters, shapes, and/or relative proportions without departing from the scope of the invention. Thus, the shaft portion 107 may be shorter or longer in comparison to, e.g., cylindrical portion 110. It is preferred that the support member 102 be made of plastic or synthetic material, which may be either a hard plastic which may be colored and/or it may be transparent or translucent. However, it should be noted that the support member 2 may be made of any desired material, conventional or otherwise, which is suitable for its intended purpose such as, e.g., any wood, ceramic, metal such as aluminum, composites, and/or including any material which includes reinforcing. If plastic is utilized, the support member 102 may be made using an injection molding process, which is known to produce such shapes efficiently and inexpensively. Of course, other methods of manufacturing such rod-like members (e.g., machining), conventional or otherwise, may be utilized without departing from the scope of the invention.

The support member 102 is, of course, designed to radially and/or rotatably support the pair of spherical weights 120 as well as the handle 104, and should therefore be designed to sustain continuous and prolonged bending or frictional wearing from each of the spheres 120 and the handle 104 without it being destroyed or otherwise strained or worn by such bending or wearing. Thus, a rigid wear resistant synthetic material is preferred.

With reference to FIGS. 22–24, it can be seen that the handle 104 includes an upper portion 108, a lower gripping portion 126, and connecting portions 138 disposed there between. The upper portion 108 has an circular portion 139 which is wider than a width of either the upper portion 108 or the lower portion 126 and includes an upper surface 127 which faces the bottom surface 105*b* of the disk 105 (see FIG. 15). A lower surface 115 of the circular portion 139 faces the washer 113 (see FIG. 15). The width of the circular portion 139 measured from upper surface 127 to the lower surface 115 added to the width of the disk measured between surface 105*a* and surface 105*b*, is designed to be approximately equal to or slightly smaller than a length between surface 109 and surface 114 of the support member 102. The handle 104 is an four sided ring-like member and includes a gripping portion 126 which may have a bulging or dual tapered middle portion (not shown) so as to be adapted to be ergonomically gripped by a user's hand. The handle 104 further includes an axial cylindrical through opening 128 which is sized and/or configured to accept the shaft portion 107 of the support member 102 (see FIG. 15). The design may be such that support member 102 is free to rotate, or not, with respect to the handle 104. As can be seen in FIG. 15, the handle 104 is designed to be fixed to the plate 105 and on the shaft portion 107 via connecting members or bolts 135. These bolts 135 have external threads which engage internal threads 136 formed in the upper portion 108 of the handle 104. Of course, the invention is not limited to the use of connecting members 135 and contemplates that the disk 105 may be fixed to the handle 104 by any mechanism, conventional or otherwise, which is suitable for its intended purpose.

However, the invention is not limited to the use of a single piece or integral handle 104 of the kind shown, and such handle 104 may include a different shape and/or may be formed as two or more individual portions which are joined together by any coupling method, conventional or otherwise. Moreover, the various portions may have different thicknesses or widths, shapes, and/or relative proportions without departing from the scope of the invention. Thus, the handle 104 may be formed from, e.g., a series of four-sided rings or a stack of rectangular washers having the same or different thicknesses. It is also preferred that the handle 104 be made of plastic or synthetic material which is textured to aid in gripping, especially in the area of gripping portion 126. The handle 104 may be made of wood, metal, either a hard plastic or soft rubber like plastic, and may be colored and/or made transparent or translucent. However, the handle 104 may also be made of any desired material, conventional or otherwise, which is suitable for its intended purpose such as, e.g., any metal such as aluminum, composites, and/or including any material which includes reinforcing: If plastic is utilized, the handle 104 may be made using an injection molding process, which is known to produce such shapes efficiently and inexpensively. Of course, other methods of manufacturing such spool-like members, conventional or otherwise, may be utilized without departing from the scope of the invention.

The handle 104 is, of course, designed to allow the user to grip the device 100 in order to rotatably support the pair of spherical weights 120 via the support member 102, and should therefore be designed to sustain continuous and prolonged bending or frictional wearing from each of the shoulder 114, washer 113 and shaft portion 107 without it being destroyed or otherwise strained by such bending or wearing. Thus, a soft, but wear resistant synthetic material is preferred.

Referring back to FIGS. 15 and 16, the invention will now be more particularly described. Each of spherical weights 120 is connected and/or secured to the device via a corresponding tension member 116 which may be a flexible tension member. This connection may be a simple design wherein one end of the tension member 116 passes through the opening 119 of each sphere 120, with its end forming a retaining knot 121. The other end of each tension member 116 is secured and/or fixed to the holding member 118 via the axial retaining member or bolt 122. According to a simple construction of the invention, a single tension member 116 is utilized with its two extended ends having a sphere 120 affixed thereto and with its middle portion being fixed to the holding member 118. According to this design, the bolt 122 is threaded into the opening 124 until the tension member 116 is compressed to such an extend that it cannot slide or otherwise move within the radial opening 117 of the holding portion 118. Of course, if a single tension member. 116 is utilized as is shown if FIG. 16, it goes without saying that the bolt 122 must engage substantially the exact middle of the tension member 116 so that the two spheres 120 will orbit and/or rotate equally distantly from the holding portion 118 and/or axis.

However, the invention also contemplates that two tension members 116 may be utilized, such that one end of each tension member 116 is fixed to a sphere 120 and another end of each is fixed to the holding portion 118. The invention further contemplates that the flexible tension member(s) 116 and the sphere(s) 120 may be formed unitarily and in one piece of the same material, which would not require the knots 121. However, it is preferred that tension member 116 be made of an inexpensive but durable string, such as e.g., a cotton or nylon string. However, any convenient tension member 116 may be utilized such as a wire, cord, cable, chain, etc, and such may be made of any material (e.g., a metal or a synthetic material), conventional or otherwise, that is suitable for its intended purpose. The invention further contemplates that the tension member(s) 116 can be made adjustable in length and/or can be formed of materials with limited elongation, and further contemplates that the materials may have significant elastic elongation. However, it is preferred that the tension members(s) 116 have limited elongation, so that the spheres 120 do not project significantly beyond the outer diameter/edge 106 of the disk 105.

It should be apparent to one skilled in the art how the Exerciser 100 shown in FIG. 15 may be assembled. Accordingly, its assembly will only briefly be described. The first step involves connecting the disk 105 to the handle 104 using bolts 135. Then the disk 105 and handle 104 slide onto shaft portion 107 of the support member 102 until openings 123/128 fits over shoulder 107. Then, the washer 113 and nuts 111, 111' may then installed over threaded portion 112 and tightened. Next, the tension member 116 may be slid through opening 117 and its ends further slid into openings 119 in each sphere 120 and knotted 121. Finally, a substantially exact middle portion of the tension member 116 is determined and the bolt 122 is tightened. The result is a device 100 in which the pair of spheres rotate and/or orbit about holding portion 118 and contact/impact one another when the device 100 is caused to move, such as when it is used for exercising and/or amusement. As can be seen in FIG. 16, this contact occurs when the pair of spheres meet.

As with the embodiments shown in FIGS. 11 and 12, this embodiment may also include a cover 29 (not shown) or a second disk 29' (not shown) to protect the spheres 120 and/or to protect the user and those it his vicinity from the spheres 120. The cover 29 and/or second disk 29' may be removably mounted to the device 100 in the same manner as that shown and described with respect to FIGS. 11 and 12.

As with the devices described in FIGS. 1–12, the devices of FIGS. 15–24 may also be inexpensively made if the spheres 120 and the disks 105, 29' and cover 29 are made of an acrylic type plastic which is transparent and durable. The support member 102 and bolts 122, 30, washer 113, and the nuts 111, 111', and 31 may also be made of a hard plastic, and the tension member 116 may be a cotton string.

Figure 25:
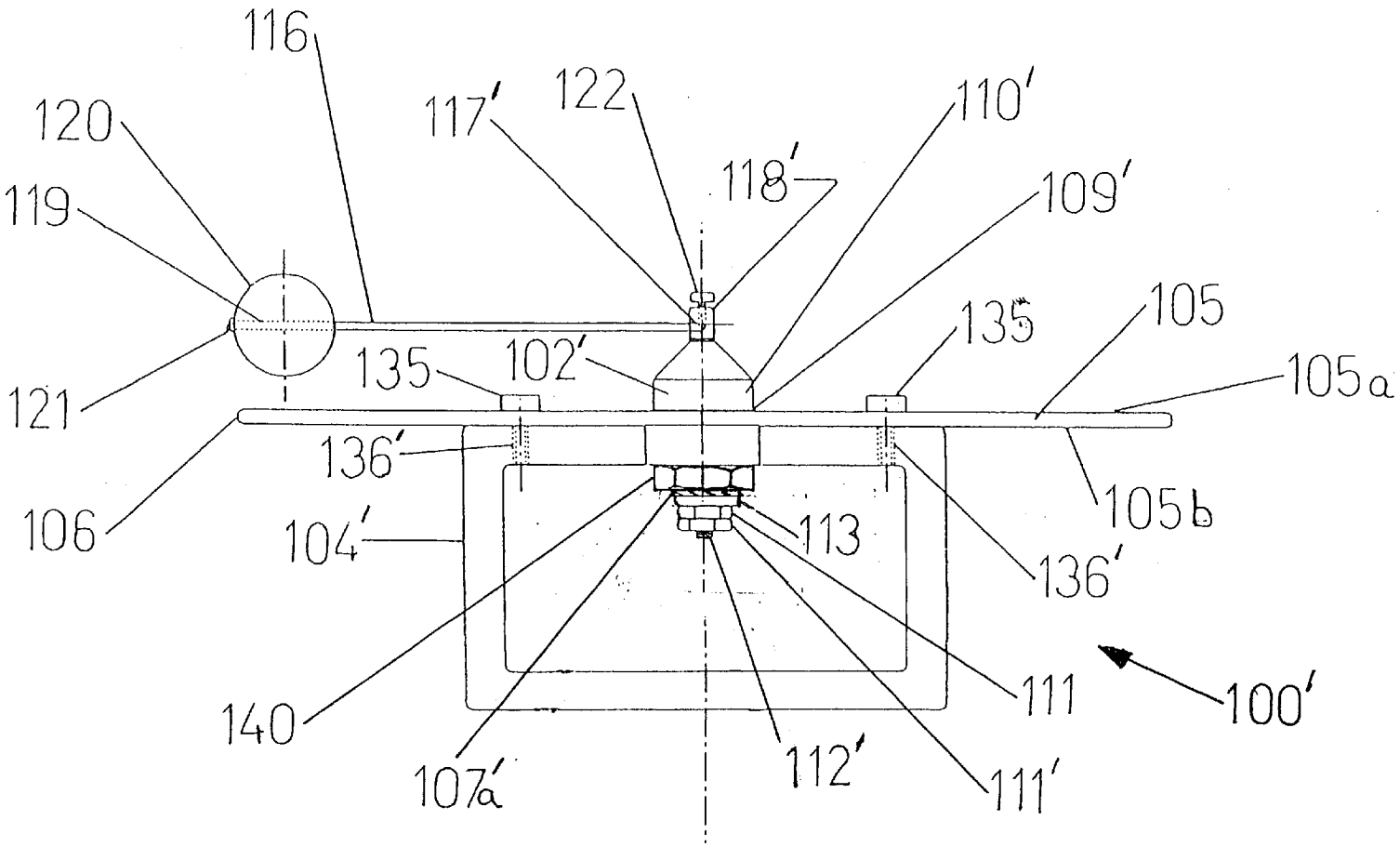
FIG. 25 shows a side view of still another exercise and/or amusement device in which a pair of spherical weights orbit about a handle with a protective disk separating the weights from the handle. In this embodiment, the central holding member 118' rotates freely with the weights.

FIG. 25 illustrates a variant of the embodiment of an exercise/amusement device shown in FIGS. 15–24, according features which are similar utilize the same reference numbers. Exerciser 100' includes a centrally located support member 102' which forms a mounting axis for a pair of orbiting and/or rotating spherical weights 120. Each spherical weight 120 is rotatably mounted to the support member 102' via a tension member 116 which may be a flexible tension member. A handle 104' is mounted to a shaft shoulder portion 107' of the support member 102'. This mounting is such that the support member 102' cannot rotate with respect to the handle 104'. A protective disk or plate 105 is arranged between the spherical weights 120 and handle 104' so as to prevent the weights 120 from injuring the user's hand, e.g., such as when the user grips the handle 104'.

Figure 26:
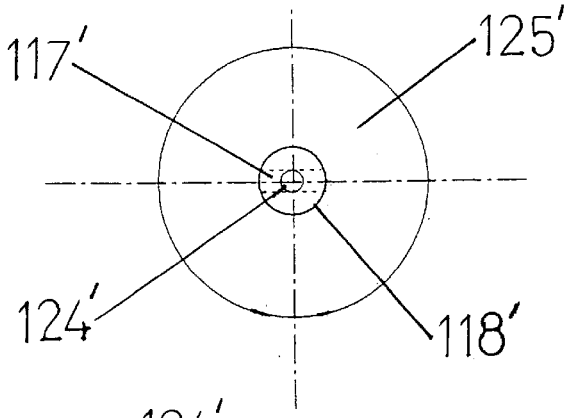
FIG. 26 shows a top view of a central support member utilized in the device shown in FIG. 25.
Figure 28:
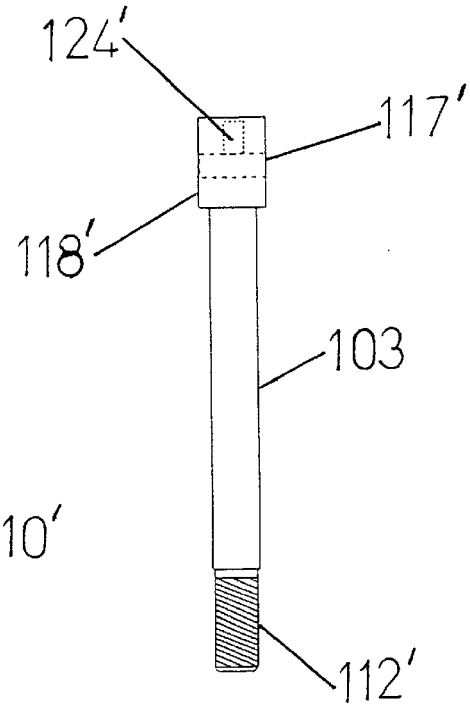
FIG. 28 shows a side view of a removable holding member which has been removed from the support member shown in FIG. 27.
Figure 27:
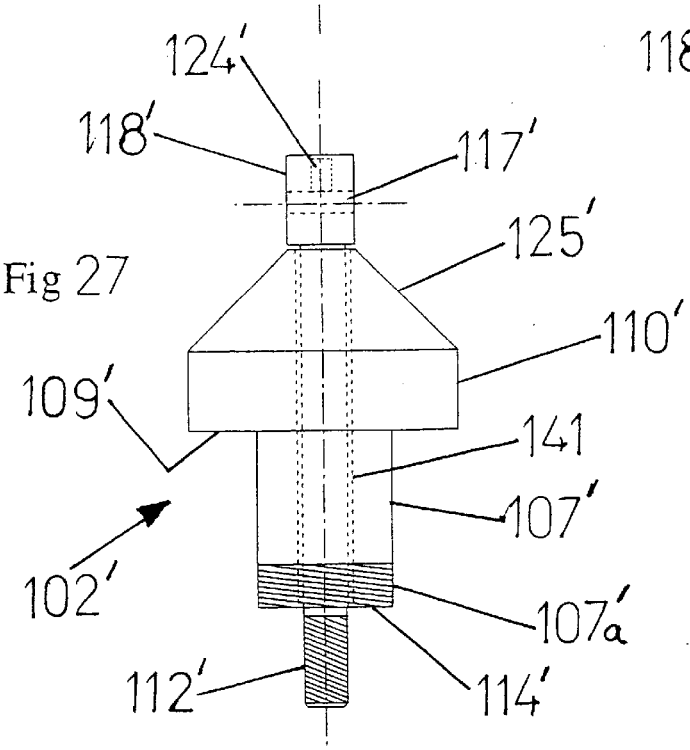
FIG. 27 shows a side view of the support member shown in FIG. 26.

With reference to FIGS. 26–28, it can be seen that the support member 102' includes an upper portion 110', 125' and 118', a lower threaded portion 112', and a shoulder shaft portion 107' and a lower threaded shaft portion 107'*a* disposed there between. The shoulder portion 107'/107'*a* has a diameter that is sized to enter into the central opening 123 of the disk 105. The shoulder portion 107' also has an axial width which approximates the width (i.e., the distance between 109' and the start of threads 107'*a*) of the disk 105 (measured between the upper surface 105*a* and the lower surface 105*b*) plus an axial width of circular portion 139' of handle 104' (measured from surface 127' to surface 115'). The support member 102' is an elongated rod-like member and includes an upper shoulder surface 109' which faces the upper surface 105*a* of the disk 105. A cylindrical portion 110' of the support member 102' is designed to extend above the upper surface 105*a* (see FIG. 25) of the disk 105. The cylindrical surface 110' terminates at the beginning of a tapered portion 125' of the support member 102', and a cylindrical holding portion 118' that is formed on a removable bolt-like member 103 extends above the tapered portion 125'. The holding portion 118' further includes an axial opening 124', whose purpose will be described hereinafter, that has internal threads which are configured to accept and/or mate with external threads of a threaded axial member 122 (see FIG. 25). The holding portion 118' also includes a side and/or radial through opening 117' which is designed and/or sized to accept the tension member(s) 116' (see FIG. 25). As discussed above, the shaft portion 107' includes a cylindrical surface and/or diameter which is sized to fit within a cylindrical through opening 128' in the handle 104' (see FIG. 29). Terminating the opposite end of the shaft portion 107' is an externally threaded portion 107'*a* which engages with internal threads in a nut 140. Terminating the opposite end of the shaft portion of bolt-like member 103 is an externally threaded end 112' whose external threads are configured to accept and/or mate with internal threads of two nuts 111 and 111' (although a single nut may also be used), with an inner nut 111 being designed to force a washer 113 against shoulder 114 of the shaft portion 107' and an outer nut 111' being designed as a lock-nut, i.e., a nut 111' which prevents nut 111 from backing out or loosening. An outside diameter of the external threaded portion 112 is accordingly sized to fit within a through opening (not shown) in a washer 113 (see FIG. 25).

This variant is characterized by the fact that the bolt-like member 103 is designed to be rotatably mounted within the support member 102' when the support member is fixed to the handle 104'. As a result of this design, the bolt-like member 103 is allowed to rotate freely with the spherical weights 120.

With reference to FIGS. 29–31, it can be seen that the handle 104' includes an upper portion 108', a lower gripping portion 126', and connecting portions 138' disposed there between. The upper portion 108' has an circular portion 139' which is wider than a width of either the upper portion 108' or the lower portion 126' and includes an upper surface 127' which faces the bottom surface 105*b* of the disk 105 (see FIG. 25). A lower surface 115' of the circular portion 139' faces the washer 113 (see FIG. 25). The width of the circular portion 139' measured from upper surface 127' to the lower surface 115' added to the width of the disk 105 (measured between surface 105*a* and surface 105*b*) is designed to be approximately equal to or slightly smaller than a length between surface 109' and a beginning of threads 107'*a* of the support member 102'. The handle 104' is an four sided ring-like member and includes a gripping portion 126' which may have a bulging or dual tapered middle portion (not shown) so as to be adapted to be ergonomically gripped by a user's hand. The handle 104' further includes an axial cylindrical through opening 128' which is sized and/or configured to accept the shaft portion 107' of the support member 102' (see FIG. 25). The design may be such that support member 102 is free to rotate, or not, with respect to the handle 104'. As can be seen in FIG. 25, the handle 104' is designed to be fixed to the plate 105 and on the shaft portion 107' via connecting members or bolts 135. These bolts 135 have external threads which engage internal threads 136' formed in the upper portion 108' of the handle 104'. Of course, the invention is not limited to the use of connecting members 135 and contemplates that the disk 105 may be fixed to the handle 104' by any mechanism, conventional or otherwise, which is suitable for its intended purpose.

As with the other embodiments, the invention is not limited to the use of a single piece or integral handle 104' of the kind shown, and such handle 104' may include a different shape and/or may be formed as two or more individual portions which are joined together by any coupling method, conventional or otherwise. Moreover, the various portions may have different thicknesses or widths, shapes, and/or relative proportions without departing from the scope of the invention. Thus, the handle 104' may be formed from, e.g., a series of four-sided rings or a stack of rectangular washers having the same or different thicknesses. It is also preferred that the handle 104' be made of plastic or synthetic material which is textured to aid in gripping, especially in the area of gripping portion 126'. The handle 104' may be made of wood, metal, either a hard plastic or soft rubber like plastic, and may be colored and/or made transparent or translucent. However, the handle 104' may also be made of any desired material, conventional or otherwise, which is suitable for its intended purpose such as, e.g., any metal such as aluminum, composites, and/or including any material which includes reinforcing. If plastic is utilized, the handle 104' may be made using an injection molding process, which is known to produce such shapes efficiently and cheaply. Of course, other methods of manufacturing such spool-like members, conventional or otherwise, may be utilized without departing from the scope of the invention.

The handle 104' is, of course, designed to allow the user to grip the device 100' in order to rotatably support the pair of spherical weights 120 via the support member 102', and should therefore be designed to sustain continuous and prolonged bending or frictional wearing from each of the shoulder 114', washer 113 and shaft portion 107' without it being destroyed or otherwise strained by such bending or wearing. Thus, a soft, but wear resistant synthetic material is preferred.

Referring back to FIGS. 25, the invention will now be more particularly described. Each of spherical weights 120 is connected and/or secured to the device via a corresponding tension member 116 which may be a flexible tension member. This connection may be a simple design wherein one end of the tension member 116 passes through the opening 119 of each sphere 120, with its end forming a retaining knot 121. The other end of each tension member 116 is secured and/or fixed to the holding member 118 via the axial retaining member or bolt 122. According to a simple construction of the invention, a single tension member 116 is utilized with its two extended ends having a sphere 120 affixed thereto and with its middle portion being fixed to the holding member 118'. According to this design, the bolt 122 is threaded into the opening 124' until the tension member 116 is compressed to such an extend that it cannot slide or otherwise move within the radial opening 117' of the holding portion 118'. Of course, if a single tension member 116 is utilized as is shown in, e.g., FIG. 25, it goes without saying that the bolt 122 must engage substantially the exact middle of the tension member 116 so that the two spheres 120 will orbit and/or rotate equally distantly from and with the holding portion 118' and/or axis.

However, the invention also contemplates that two tension members 116 may be utilized, such that one end of each tension member 116 is fixed to a sphere 120 and another end of each is fixed to the holding portion 118'. The invention further contemplates that the tension member(s) 116 and the sphere(s) 120 may be formed unitarily and in one piece of the same material, which would not require the knots 121. However, it is preferred that tension member 116 be made of an inexpensive but durable string, such as e.g., a cotton or nylon string. However, any convenient flexible tension member 116 may be utilized such as a wire, cord, cable, chain, etc, and such may be made of any material (e.g., a metal or a synthetic material), conventional or otherwise, that is suitable for its intended purpose. The invention further contemplates that the tension member(s) 116 can be made adjustable in length and/or can be formed of materials with limited elongation, and further contemplates that the materials may have significant elastic elongation. However, it is preferred that the tension members(s) 116 have limited elongation, so that the spheres 120 do not project significantly beyond the outer diameter/edge 106 of the disk 105.

It should be apparent to one skilled in the art how the Exerciser 100' shown in FIG. 25 may be assembled. Accordingly, its assembly will only briefly be described. The first step involves connecting the disk 105 to the handle 104' using bolts 135. Then, the disk 105 and handle 104' slide onto shaft portion 107' of the support member 102' until openings 123/128 fit over shoulder 107'. Then, nut 140 is threaded onto threaded portion 107'*a* and tightened so that the support member 102' cannot rotate with respect to handle 104' and disk 105. Then, the washer 113 and nuts 111, 111' may installed over threaded portion 112' and tightened. Next, the tension member 116 may be slid through opening 117' and its ends further slid into openings 119 in each sphere 120 and knotted 121. Finally, a substantially exact middle portion of the tension member 116 is determined and the bolt 122 is tightened. The result is a device 100' in which the pair of spheres rotate and/or orbit with holding portion 118' and contact/impact one another when the device 100' is caused to move, such as when it is used for exercising and/or amusement. As can be seen in, e.g., FIG. 16, this contact occurs when the pair of spheres meet.

As with the embodiments shown in FIGS. 11 and 12, this embodiment may also include a cover 29 (not shown) or a second disk 29' (not shown) to protect the spheres 120 and/or to protect the user and those it his vicinity from the spheres 120. The cover 29 and/or second disk 29' may be removably mounted to the device 100' in the same manner as that shown and described with respect to FIGS. 11 and 12.

As with the devices described in FIGS. 1–24, the devices of FIGS. 25–31 may also be inexpensively made if the spheres 120 and the disks 105, 29' and cover 29 are made of an acrylic type plastic which is transparent and durable. The support member 102 and bolts 122, 30, washer 113, and the nuts 111, 111', and 31 may also be made of a hard plastic, and the tension member 116 may be a cotton string.

Turning now to the operation of the exercise/amusement device shown in FIGS. 15–31, the user can grasp or grip the handle 104 or 104' with either or both of his hands. Next, the user imparts to the device 100 or 100' a movement which may be in any number of directions such as, e.g., substantially vertical, horizontal, linear, curvilinear, or circular reciprocating motion, or any combination thereof. However, it is preferred that the movement be in any plane which is perpendicular to an axis running through the handle 104 or 104'/support member 102 or 102'. Thus, this movement M may be linear as shown in FIGS. 9 and 14. Moreover, a substantially orbital, curvilinear, or circular continuous motion or movement M can also be imparted to the exercise/amusement device 100 or 100' as shown in FIGS. 10 and 13. Depending on the motion imparted to the device 100 or 100', the weights or spheres 120 coupled to the holding portion 118 or 118' are caused to move with a circular reciprocating motion and eventually collide with one another at the end of each half cycle or move together with a circular continuous motion. Accordingly, such motion gives the user of the device 100 or 100' a unique exercise and/or amusement experience which is different from that of conventional exercise or amusement devices.

As with other embodiments described herein, the user may also place a exerciser in each hand and execute either the same movement M with each hand or different movements with each hand. Moreover, the movements M may be preestablished so that the user can complete an exercise or amusement routine or purely random movements M in any direction. Additionally, the user may perform any number of these movements alone or in the company of other users in either a coordinated effort or with each user being allowed to perform their movements randomly.

Figure 32:
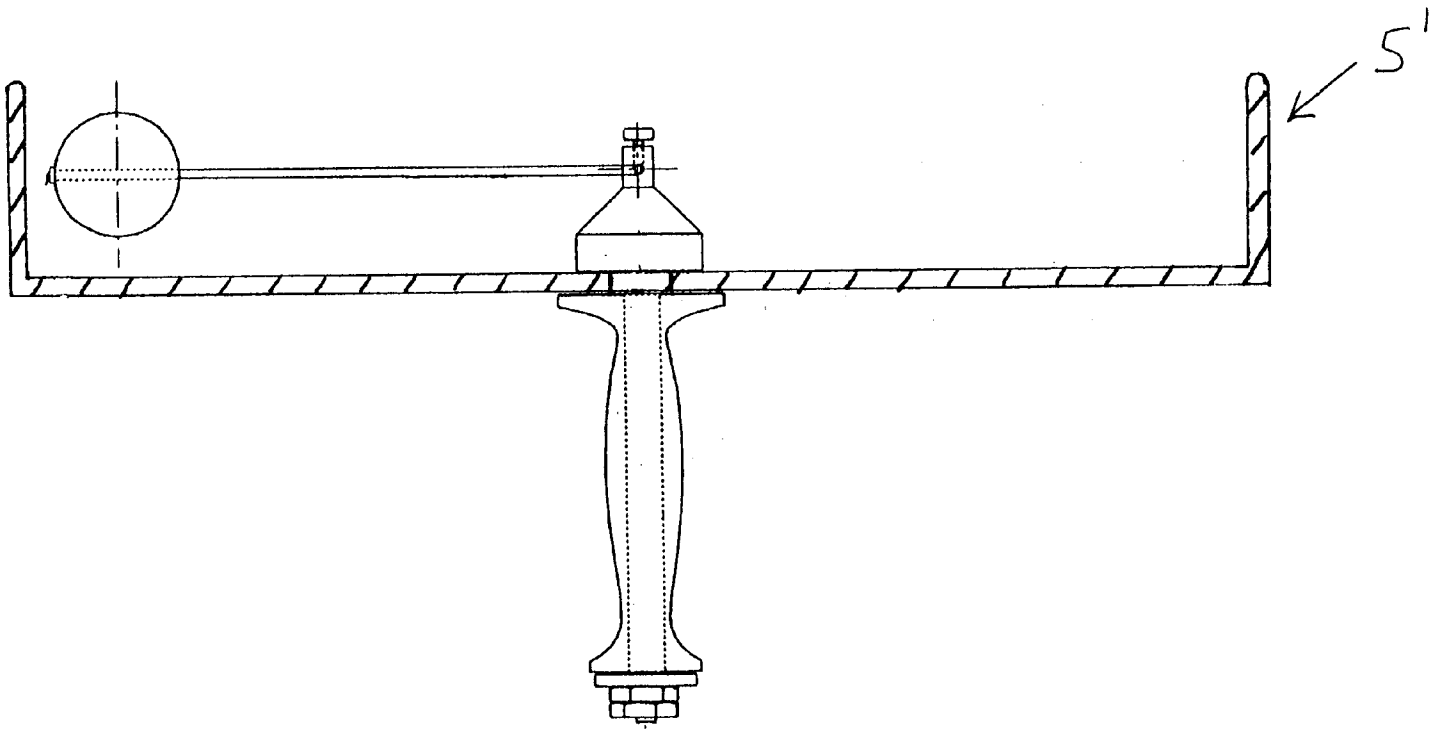
FIG. 32 shows a side view of the exercise and/or amusement device similar to that shown in FIG. 1, except that a cup or bowl-shaped protective disk (shown in cross-section) is utilized instead a simple plate-like protective disk.

FIG. 32 illustrates an embodiment of an exercise/amusement device similar to that of FIG. 1 except that a cup-shaped or bowl-shaped protective disk 5' is provided. The disk 5' has raised sides and is otherwise similar to the disk 1 (and can be manufactured the same way) shown in FIG. 1. However, that the present invention contemplates that this disk 5' may be used on any of the disclosed embodiments, e.g., FIGS. 1, 15 and 25. In a manner similar to that of protective disk or plate 5, this cup-shaped disk 5' can be arranged between the spherical weights and the handle so as to prevent the weights from injuring the user's hand, when the user grips the handle.

Figure 33:
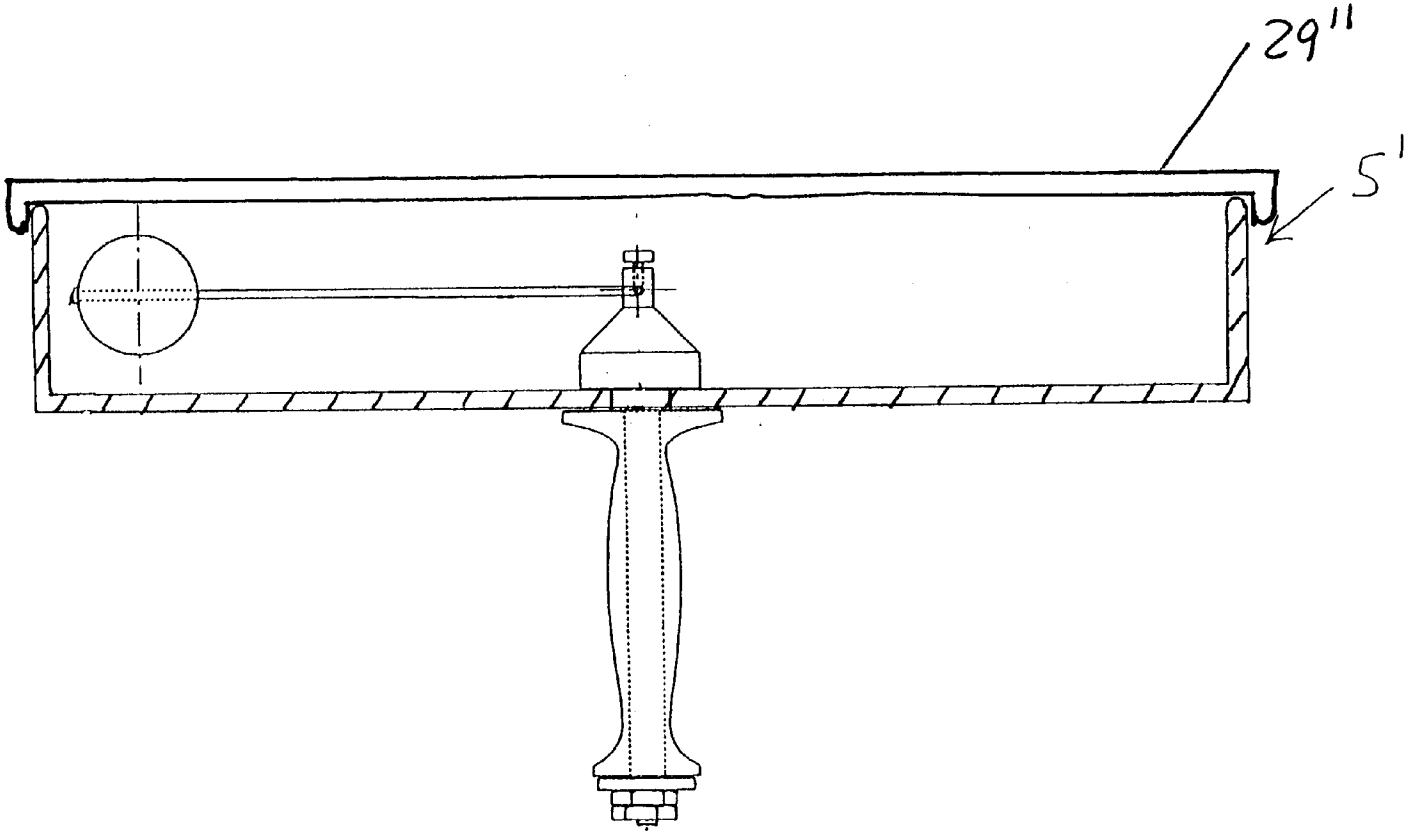
FIG. 33 shows a variant of the embodiment shown in FIG. 32 which includes a cover.

FIG. 33 shows how the embodiment of FIG. 32 can include a cover 29". This embodiment is characterized as having many similar features to the embodiment just described, except that it also includes a cover 29" to protect the spheres and/or to protect the user and those in the vicinity of the user from the spheres. The cover 29" may be removably mounted to the device via an overlapping connection, i.e, a outer lip of the cover 29" can frictionally engage and overlap the raised side of the cup-shaped disk 5'.

However, it should be noted that the invention also contemplates attaching the cover 29" to the device using any other convenient attachment mechanism, conventional or otherwise.

It should be noted that the invention, in all embodiments, is not limited to a circular disks 5, 5', 105, and 29', or circular cover 29 and 29". Other shapes are also contemplated such as, e.g., square, polygonal, oval, or the like, as long as such shapes allow the weights or spheres 20, 120 to move in a circular fashion. Moreover, the disks 5, 5, 105, 29' and covers 29 and 29" need not be made with a solid surface. Accordingly, each or only one or more may have many openings to allow the user to view the weights moving within—a feature which may be particularly advantageous when these parts are made of a material which is not at least partially transparent.

Again, it should also be noted that in all variants of the invention, the partially spherically shaped weights may be made of any suitable plastic material, iron, steel or other metals. The other parts of the variations may be made of transparent plastic material or any other suitable material. Moreover, the various materials used may be colored in any color desired by the user and/or may have any desired exterior embossments and/or indentations and may even include advertisements and various indentations for containing such advertisements. When any lighter weight material is used for the various parts, structural reinforcements may be used. Such reinforcement material may be applied either integrally or separately to the materials.

It is noted that the foregoing disclosure has been provided merely for the purpose of explanation and is in no way to be construed as limiting of the present invention. While the present invention has been described with reference to at least one preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An handheld exercise or amusement device, comprising:

a handle adapted to be gripped by a user;

at least two weights being freely orbitally mounted about an axis running through the handle; and one of a disk and a plate disposed between the at least two weights and the handle, wherein the disk or the plate prevents the at least two weights from injuring the user gripping the handle, wherein the at least two weights can orbit on a common plane and are capable of contacting one another at two opposite positions.

2. An handheld exercise or amusement device, comprising:

a handle adapted to be gripped by a user; and at least two weights being freely orbitally mounted to a support member and about an axis running through the handle, wherein the handle is rotatably mounted to the support member.

3. The device of claim 1, further comprising a support member, wherein the at least two weights are coupled to the support member via at least one tension member.

4. The device of claim 1, wherein each of the at least two weights comprises a sphere.

5. The device of claim 1, further comprising at least one tension member for coupling each of the at least two weights to the device.

6. An handheld exercise or amusement device, comprising:

a handle adapted to be gripped by a user;

at least two weights being freely orbitally mounted about an axis running through the handle; and one of a circular disk and a circular plate disposed between the at least two weights and the handle.

7. The device of claim 1, further comprising:

a support member, wherein the handle is rotatably mounted to the support member, and wherein each of the at least two weights is coupled to the support member via a single tension member.

8. The device of claim 7, wherein each of the at least two weights comprises a sphere.

9. The device of claim 7, further comprising a mechanism for securing a portion of the at least one tension member to the support member.

10. The device of claim 7, further comprising at least one retaining mechanism, wherein the at least one retaining mechanism is adapted to axially retain the handle on the support member.

11. The device of claim 10, wherein the at least one retaining mechanism comprises at least one washer and at least one nut.

12. The device of claim 1, wherein the handle comprises an ergonomic gripping surface.

13. The device of claim 1, wherein the handle comprises at least one of a soft and high friction gripping surface.

14. An handheld exercise or amusement device, comprising:

a handle adapted to be gripped by a user;

at least two weights being freely orbitally mounted about an axis running through the handle; and a first disk arranged between the at least two weights and the handle and at least one of a second disk and a cover arranged on a side of the at least two weights opposite the handle.

15. An handheld exercise or amusement device, comprising:

a support member;

a handle adapted to be gripped by a user; and at least two weights being at least one of freely rotatably mounted and freely orbitally mounted about an axis running through the handle, wherein the handle is rotatably mounted to the support member, wherein the at least two weights are coupled to the support member via at least one tension member, and wherein the at least two weights can orbit on a common plane and are capable of contacting one another at two opposite positions.

16. The device of claim 15, wherein each of the at least two weights comprises a spherical shape.

17. The exerciser of claim 15, wherein at least one of the handle, the at least two weights, and the support member comprises a plastic.

18. The exerciser of claim 15, wherein the at least one tension member comprises a string.

19. An handheld exercise or amusement device, comprising:

a support member;

a handle adapted to be gripped by a user;

at least two weights being at least one of freely rotatably mounted and freely orbitally mounted about an axis running through the support member; and one of a plate and a disk arranged between the handle and the at least two weights, wherein the handle is rotatably mounted to the support member, wherein the at least two weights are coupled to the support member via at least one tension member.

20. A method of exercising using the device of claim 1, the method comprising:

gripping the handle with at least one hand;

moving the exerciser in at least one direction; and causing the at least two weights to orbit on a common plane and to contact one another at two opposite positions.

21. A method of exercising using an exerciser device that includes a support member, a handle adapted to be gripped by a user, and at least two weights being at least one of freely rotatably mounted and freely orbitally mounted about an axis running through the handle, wherein the handle is rotatably mounted to the support member and wherein the at least two weights are coupled to the support member via at least one tension member, the method comprising:

gripping the handle with at least one hand;

moving the exerciser device in at least one direction; and causing the at least two weights to orbit on a common plane and to contact one another at two opposite positions.

22. A method of exercising using an exerciser device that includes a support member, a handle adapted to be gripped by a user, at least two weights being at least one of freely rotatably mounted and freely orbitally mounted about an axis running through the support member, each of the at least two weights being coupled to the support member via a single flexible tension member and one of a plate and a disk arranged between the handle and the at least two weights, wherein the handle is rotatably mounted to the support member and wherein the at least two weights are coupled to the support member via at least one tension member, the method comprising:

gripping the handle with at least one hand; and moving the exerciser device in at least one direction.

23. An handheld exercise or amusement device, comprising:

a handle adapted to be gripped by a user;

at least two weights being at least one of freely rotatably mounted and freely orbitally mounted about an axis; and a plate member disposed between the handle and the at least two weights, wherein plate member extends outwardly beyond a center each of the at least two weights.

24. The device of claim 23, wherein the plate member is at least one of fixed and non-rotatably mounted to the handle.

25. The device of claim 23, further comprising a support member, wherein the support member is rotatably mounted to the handle.

26. The device of claim 23, further comprising a support member, wherein the support member is at least one of fixed and non-rotatably mounted to the handle.

27. The device of claim 23, further comprising a support member, wherein the at least two weights are coupled to the support member via at least one tension member.

28. The device of claim 27, wherein the at least one tension member comprises a flexible tension member.

29. The device of claim 23, wherein each of the at least two weights comprises a sphere.

30. The device of claim 23, further comprising at least one flexible tension member for coupling each of the at least two weights to the device.

31. The device of claim 23, wherein the plate member comprises a protective disk.

32. The device of claim 23, further comprising:

a support member, an axial member rotatably mounted to the support member; and the handle being fixed to the support member, wherein the at least two weights are coupled to the axial member via at least one tension member.

33. The device of claim 32, wherein each of the at least two weights comprises a sphere.

34. The device of claim 32, further comprising a mechanism for securing a portion of the at least one tension member to the axial member.

35. The device of claim 32, further comprising at least one retaining mechanism, wherein the at least one retaining mechanism is adapted to axially retain the handle on the support member.

36. The device of claim 35, wherein the at least one retaining mechanism at least one washer and at least one nut.

37. The device of claim 23, wherein the handle comprises at least one of a soft and high friction gripping surface.

38. The device of claim 23, wherein the plate member comprises a first disk and further comprising at least one of a second disk and a cover arranged on a side of the at least two weights opposite the handle.

39. An handheld exercise or amusement device, comprising:

a handle adapted to be gripped by a user; and at least two weights being at least one of freely rotatably mounted and freely orbitally mounted about an axis, wherein the handle comprises a gripping opening which is defined by side portions and a gripping portion arranged between the side portions.

40. The device of claim 39, further comprising a plate member disposed between the handle and the at least two weights.

41. An handheld exercise or amusement device, comprising:

a handle adapted to be gripped by a user;

at least two weights being at least one of freely rotatably mounted and freely orbitally mounted about an axis;

each of the at least two weights being coupled to a single flexible tension member; and an enclosure completely enclosing the at least two weights.

42. The device of claim 41, wherein the handle comprises a gripping opening which is defined by side portions and a gripping portion that is oriented parallel to a bottom wall of the enclosure.

* * * * *

UNITED STATES PATENT AND TRADEMARK OFFICE

CERTIFICATE OF CORRECTION

PATENT NO. : 6,776,742 B2
DATED : August 17, 2004
INVENTOR(S) : A. Domenge

It is certified that error appears in the above-identified patent and that said Letters Patent is hereby corrected as shown below:

Column 24,
Line 44, after “handle;” delete “and”.
Line 46, after “handle” insert -- ; --.

Column 26,
Line 35, after “mechanism” insert -- comprises --.

Signed and Sealed this

Twenty-eighth Day of June, 2005

JON W. DUDAS
*Director of the United States Patent and Trademark Office*